US009463343B2

(12) United States Patent
Koiwa

(10) Patent No.: US 9,463,343 B2
(45) Date of Patent: Oct. 11, 2016

(54) PROTECTING CAP AND SPRINKLER HEAD

(71) Applicant: SENJU SPRINKLER CO., LTD., Tokyo (JP)

(72) Inventor: Yasuaki Koiwa, Tokyo (JP)

(73) Assignee: Senju Sprinkler Co., Ltd., Tokyo (JP)

( * ) Notice: Subject to any disclaimer, the term of this patent is extended or adjusted under 35 U.S.C. 154(b) by 231 days.

(21) Appl. No.: 13/751,225

(22) Filed: Jan. 28, 2013

(65) Prior Publication Data

US 2013/0306334 A1 Nov. 21, 2013

(30) Foreign Application Priority Data

May 21, 2012 (JP) ..... 2012-115326

(51) Int. Cl.

| | |
|---|---|
| ***A62C 35/00*** | (2006.01) |
| ***A62C 37/12*** | (2006.01) |
| ***A62C 37/08*** | (2006.01) |
| ***B05B 15/00*** | (2006.01) |

(52) U.S. Cl.

CPC ..... *A62C 35/00* (2013.01); *A62C 37/12* (2013.01); *A62C 37/08* (2013.01); *B05B 15/001* (2013.01)

(58) Field of Classification Search

CPC ..... A62C 35/00; A62C 37/08–37/16; B05B 15/001

USPC ..... 169/51, 37–41, 57–59; 239/288–288.5; 285/46

See application file for complete search history.

(56) References Cited

U.S. PATENT DOCUMENTS

| | | | | |
|---|---|---|---|---|
| 4,014,388 | A * | 3/1977 | Anderson | 169/37 |
| 4,706,759 | A | 11/1987 | Grasseschi | |
| 4,880,063 | A * | 11/1989 | Leininger et al. | 169/37 |
| 5,372,203 | A | 12/1994 | Galaszewski | |
| 6,484,809 | B1 * | 11/2002 | Elder | A62C 31/28 169/37 |
| 7,055,614 | B1 | 6/2006 | Ide | |
| 7,540,330 | B2 * | 6/2009 | Orr et al. | 169/37 |
| 2010/0236797 | A1 * | 9/2010 | VanEerden et al. | 169/51 |
| 2010/0243282 | A1 * | 9/2010 | Rekeny | 169/51 |
| 2011/0247836 | A1 * | 10/2011 | Takeuchi | 169/37 |

FOREIGN PATENT DOCUMENTS

| | | | |
|---|---|---|---|
| JP | 2001-161852 | A | 6/2001 |
| WO | WO2011/058382 | A1 | 5/2011 |
| WO | WO2011/125921 | A1 | 10/2011 |

* cited by examiner

*Primary Examiner* — Len Tran
*Assistant Examiner* — Cody Lieuwen
(74) *Attorney, Agent, or Firm* — Cermak Nakajima & McGowan LLP; Tomoko Nakajima

(57) ABSTRACT

There is provided a protecting cap configured to protect a sprinkler, the protecting cap having a bottomed cylindrical shape including a bottom surface and a cylinder, having an inner cylinder with a bottom surface and a head housing portion which is configured to house the sprinkler head body, and an outer cylinder to be fitted in an end portion of the cylindrical member; the outer cylinder circumferentially surrounding an outside of the inner cylinder, a tongue portion extending from the inner cylinder and projecting into an opening provided in an upper portion of the cylindrical member; a fastening tool insertion portion, located between the inner cylinder and the outer cylinder, configured to allow insertion of a fastening tool for mounting the sprinkler on a water supply pipe, and includes a coupling portion configured to connect the inner cylinder and the outer cylinder.

20 Claims, 18 Drawing Sheets

(a)

(b)

(a)

(b)

(a)

(b)

(a)

(b)

PROTECTING CAP AND SPRINKLER HEAD

BACKGROUND OF THE INVENTION

1. Technical Field

The present invention relates to a protecting cap configured to protect a sprinkler head for extinguishing fire from an external impact and a sprinkler head on which the protecting cap is mounted.

2. Background Art

A sprinkler head is mounted on a ceiling surface or a wall surface in a building, and has a nozzle configured to be connectable to a pipe continuing to a water supply source at one end thereof and a heat-sensitive actuating unit provided on the other end thereof. In a normal state, the heat-sensitive actuating unit supports a valve body configured to close the nozzle.

As an example of the sprinkler head, there is a concealed-type sprinkler head configured to be mounted in a state of being embedded in the ceiling surface or the wall surface, in which the sprinkler head is hidden and covered by a cover plate. The concealed head is used as a sprinkler head superior in design and, for example, there is the one described in WO 2011/058382.

The concealed-type sprinkler head disclosed in WO 2011/058382 includes a cylinder member mounted on the outside of the body to be connected to a water supply pipe, and the cylinder member is formed with an engaging portion to allow the engagement of a fastening tool in the interior thereof. The engaging portion of the fastening tool has a structure which may engage the fastening tool in a state in which a protecting cap is mounted on the cylindrical member.

Accordingly, the concealed-type sprinkler head allows the fastening tool to engage therewith without demounting the protecting cap, and the concealed-type sprinkler head having the protecting cap mounted thereon may be screwed into a water supply pipe by engaging the fastening tool therewith, so that the burden of an operator is alleviated.

PATENT LITERATURE

PTL 1: WO 2011/058382

However, in the case of the above-described concealed-type sprinkler head, if paint is sprayed on the ceiling surface after having connected the sprinkler head to the water supply pipe, the paint may be adhered to the interior of a cylindrical member of the concealed-type sprinkler head. Accordingly, there arises a problem that when engaging a cover plate unit with the cylindrical member after having painted the ceiling surface, a cylindrical portion of the cover plate unit and the interior of the cylindrical member are rubbing against each other, and hence the paint peels off and interferes with a cover plate unit mounting operation and the workability is lowered.

As illustrated in FIG. 11, when a hole H which allows insertion of a concealed-type sprinkler head 100 is formed in a ceiling board C, if the formed hole H is inadvertently large, an edge of the hole H may be filled with a paste 103. At that time, when the paste 103 enters the inside a cylindrical member 102 beyond an inner diameter thereof, a protecting cap 104 may hardly be pulled out after the paste 103 is hardened. In addition, a cover plate unit 105 to be engaged with the interior of the cylindrical member 102 after the protecting cap 104 has pulled out is hindered by the paste 103 adhered to the interior of the cylindrical member 102 when being mounted.

In order to solve the above-described problems, it is contemplated that the protecting cap is formed into a bottomed cylindrical shape, and an outer peripheral surface of the protecting cap is fitted so as to extend along an inner peripheral surface of the cylindrical member. In this configuration, however, there arises a new problem that the fastening tool cannot be locked to the engaging portion for the fastening tool formed in the interior of the cylindrical member.

In a case where the outer peripheral surface of the protecting cap is fitted so as to extend along the inner peripheral surface of the cylindrical member, if the degree of fitting between the protecting cap and the cylindrical member is too loose, the protecting cap may drop off the cylindrical member only by vibrations or even by a light hitting of a substance, so that there arises a probability that the paint is adhered to an inner peripheral portion of the cylindrical member or the sprinkler head cannot be protected from an external impact. In contrast, if the degree of fitting is too hard, the burden of the operator required when demounting the protecting cap may be increased, or the operation may take a long time.

SUMMARY OF THE INVENTION

In view of such a problem, it is an object of the invention to provide a protecting cap which allows engagement with a fastening tool in a state in which the protecting cap is mounted on a concealed-type sprinkler head, prevents adhesion of paint on an inner peripheral portion of a cylindrical member, and alleviates a burden of an operator, and a sprinkler head on which the protecting cap may be mounted.

In order to achieve the above-described object, the invention provides a protecting cap and a sprinkler head as described below.

There is provided a protecting cap configured to protect a sprinkler head by being mounted on a sprinkler having a sprinkler head body and a cylindrical member provided on the outside thereof, the protecting cap having a bottomed cylindrical shape including a bottom surface and a cylinder, including: a tongue portion projecting into an opening provided in an upper portion of the cylindrical member; an outer peripheral portion to be fitted in an end portion of the cylindrical member, a head housing portion configured to house the sprinkler head body, and a fastening tool insertion portion configured to allow insertion of a fastening tool for mounting the sprinkler on a water supply pipe, wherein the cylinder is formed into a duplicated cylinder having an inner cylinder and an outer cylinder, the outer peripheral portion is defined by the outer cylinder, the head housing portion is formed inside the inner cylinder, and includes a coupling portion configured to connect the inner cylinder and the outer cylinder.

By providing the tongue portion so as to project into the opening provided on an upper portion of the cylindrical member, the protecting cap may be arranged at a predetermined position with respect to the cylindrical member, and since the outer peripheral portion is fitted to the end portion of the cylindrical member, the protecting cap may be mounted and held on the cylindrical member.

Since the bottomed cylindrical shape having the bottom surface and the cylinder is employed, the head housing portion configured to house the sprinkler head body in the interior thereof may be provided. By housing the sprinkler head body in the head housing portion, the sprinkler head body may be protected from an external impact.

Since the fastening tool insertion portion which allows insertion of the fastening tool for mounting the sprinkler on the water supply pipe is provided, the sprinkler may be mounted on or demounted from the water supply pipe in a state in which the protecting cap is mounted on the cylindrical member.

Since the cylinder is formed into the duplicated cylinder having the inner cylinder and the outer cylinder, the outer peripheral portion is defined by the outer cylinder, and the head housing portion is formed inside the inner cylinder, fitting to the cylindrical member may be achieved by the outer cylinder and the sprinkler head body may be housed in the inner cylinder.

Also, the inner cylinder and the outer cylinder may be integrated by the coupling portion, and when the protecting cap is mounted on and demounted from the sprinkler head body, the inner cylinder and the outer cylinder may be mounted and demounted with a single operation. The protection cap of the embodiment disclosed here is inserted into the cylindrical member from a lower end thereof, and the outer cylinder of the protecting cap covers the entire surface of the inner periphery of the cylindrical member so that the outer cylinder of the protecting cap holds an inner peripheral portion of the cylindrical member by pressing the same. Since a space is formed between the inner cylinder and the outer cylinder where the coupling portion is provided, the outer cylinder is capable of contracting toward the inner cylinder and a force that presses the inner peripheral portion of the cylindrical member is generated in the outer cylinder in the contracted state, so that the outer cylinder holds the inner peripheral portion of the cylindrical member by pressing the same to prevent the protecting cap from dropping.

The coupling portion may be used as an engaging portion with respect to the tool, and the fastening tool may be engaged with the fastening tool engaging portion provided on the sprinkler head body via the coupling portion. It is also possible to engage the tool for demounting the protecting cap from the sprinkler head body with the coupling portion and pull out the protecting cap from the sprinkler head body.

Also, when painting a ceiling wall around the sprinkler head after the sprinkler head has temporarily mounted in the ceiling or the like, the inner peripheral portion of the cylindrical member is fitted to the outer peripheral portion of the protecting cap so as to prevent the paint from adhering on the inner peripheral portion of the cylindrical member. In addition, the fastening tool insertion portion and the head housing portion are divided by the inner cylinder so as to prevent the paint entering from the fastening tool insertion portion from adhering on the sprinkler head body.

According to the embodiment disclosed here, a penetrating space penetrating from one end side to the other end side of the protecting cap is formed between the inner cylinder and the outer cylinder. In this configuration, the fastening tool may be inserted into the penetrating space. The penetrating space and the coupling portion exist between the inner cylinder and the outer cylinder, and the coupling portion is deflected and the outer cylinder is prone to resilient deformation toward the inner cylinder owing to the penetrating space when the protecting cap is mounted on and demounted from the sprinkler head body and hence the protecting cap is prone to deformation and allows easy mounting and demounting operations. Also, since the fastening tool to be inserted into this space is partitioned from the sprinkler head by the inner cylinder, the fastening tool is prevented from giving damage to the sprinkler head.

When the sprinkler head having the protecting cap is temporarily mounted in the ceiling, there is a case where a gap generated between the sprinkler head and the ceiling wall is filled with paste. The protecting cap on which the paste is adhered is needed to be demounted so as not to give damage to the paste. However, the gap is formed between the tongue portion and the edge of the opening in a state in which the tongue portion projects into the opening of the cylinder member. Therefore, the protecting cap may be rotated by an extent corresponding to the gap and hence the protecting cap may easily be demounted without giving damage to the paste.

According to the embodiment disclosed here, the protecting cap is provided with the tongue portion for mounting the protecting cap at a predetermined position on the sprinkler head body or the cylinder member, and the tongue portion and the fastening tool insertion portion may be aligned on a straight line parallel to a virtual center axis of the cylinder which constitutes the protecting cap.

In this configuration, an operator is capable of inserting the fastening tool into the fastening tool insertion portion mounted on the extended line with the tongue portion as a mark, so that the insertion of the fastening tool may be performed quickly.

According to the embodiment disclosed here, the coupling portion may be formed in a direction parallel to the virtual center axis of the cylinder. In this configuration, the fastening tool may be engaged with the fastening tool engaging portion of the sprinkler head body or the cylinder member in a state in which the fastening tool inserted between the outer cylinder and the inner cylinder is in abutment with the coupling portion.

According to the embodiment disclosed here, the coupling portion may be formed in a direction intersecting the virtual center axis of the protecting cap. In this configuration, the protecting cap may be pulled out from the cylinder member by hitching the tool on the coupling portion.

According to the embodiment disclosed here, an extended portion substantially equal to the outer diameter of the cylinder member may be mounted on the lower end side of the outer cylinder. Since the extended portion extending downward from the lower end position of the cylinder member on the outer cylinder, when a hole to allow insertion of the sprinkler head is formed in the ceiling, the operator instinctively knows the size of the hole to be formed in the ceiling with reference to the outer diameter of the extended portion. In the configuration in which a lower portion of the extended portion projects downward beyond a ceiling surface, when a peripheral edge of the hole in the ceiling through which the sprinkler head is inserted is filled with paste, the extended portion prevents the paste from adhering in the interior of the cylinder member.

According to the sprinkler head of the embodiment disclosed here, a groove configured to engage a projection formed on the outer peripheral surface of the fastening tool is formed inside the extended portion. When the groove is formed as an engaging portion with respect to the fastening tool inside the extended portion and the fastening tool is formed with the projection capable of engaging the groove, the protecting cap and the fastening tool may be engaged at a predetermined position. Also, the fastening tool may be inserted into the protecting cap using the engaging portion as a mark.

According to the embodiment disclosed here, an end portion of a gripping portion formed on the bottom surface of the head housing portion may be arranged in the vicinity of the groove which is the engaging portion with respect to the fastening tool which is provided inside the extended portion. Accordingly, when the groove which is the engaging portion with respect to the fastening tool inside the extended portion is hardly visible in a darkish environment, the fastening tool may be inserted into the groove provided inside the extended portion using the end portion of the grip portion as a mark.

According to the embodiment disclosed here, a water drain hole which reaches partly the inner cylinder may be formed at an edge of the bottom surface. Accordingly, the water drain hole is formed three dimensionally, and hence good water draining properties are achieved.

According to the embodiment disclosed here, the bottom surface of the head housing portion may be formed as an inclined surface having a downward gradient toward the water drain hole. In this configuration, water in the inner cylinder may be guided to the water drain hole by the inclined surface and hence good water draining property is achieved.

According to the embodiment disclosed here, a hole or a notch may be formed on the outer peripheral portion (outer cylinder) of the protecting cap. In this configuration, for example, by providing the notch on the outer peripheral portion of the protecting cap, the outer peripheral portion of the protecting cap is allowed to be resiliently deformed inward so that mounting and demounting of the cylinder member and the protecting cap may be performed smoothly.

Also, the inner cylinder may include a notch notched in the vertical direction, and the coupling portion may be provided at a notched end of the inner cylinder. In this configuration as well, the fastening tool insertion portion and the head housing portion may be partitioned.

The tongue portion may include a deformation allowing portion deformable by the rotating motion of the protecting cap. In this configuration, the tongue portion may be deformed or separated easily by an external force. Therefore, the protecting cap may be rotated, and may be demounted easily.

Also, since the fastening tool insertion portion is provided on the protecting cap, the sprinkler may be mounted on or demounted from the water supply pipe by inserting the fastening tool into the fastening tool insertion portion in a state in which the protecting cap is mounted on the cylinder member of the sprinkler head provided with the sprinkler head body and the cylinder member.

By allowing the connection of a cap demounting tool with the coupling portion, the protecting cap may be demounted from the cylinder member using the cap demounting tool.

According to the sprinkler head of the embodiment disclosed here, the inner cylinder configured to isolate the fastening tool insertion portion and the head housing portion is formed. In this configuration, the inner cylinder may prevent liquid such as paint from entering the head housing portion from the fastening tool insertion portion. By the formation of the inner cylinder, the fastening tool may be moved along the inner cylinder when the fastening tool is inserted into the fastening tool insertion portion.

Furthermore, with the bottom surface having the fastening tool insertion portion, the position where the fastening tool is to be inserted may be confirmed easily from the lower side.

Also, there is provided a protecting cap configured to protect a sprinkler head by being mounted on a sprinkler having a sprinkler head body and a cylindrical member provided on the outside thereof, the protecting cap having a bottomed cylindrical shape including a bottom surface and a cylinder, including: a tongue portion projecting into an opening provided in an upper portion of the cylindrical member; an outer peripheral portion to be fitted in an end portion of the cylindrical member, a head housing portion configured to house the sprinkler head body, and a fastening tool insertion portion configured to allow insertion of a fastening tool for mounting the sprinkler on a water supply pipe, wherein the fastening tool insertion portion is provided with a lid configure to close the fastening tool insertion portion.

Since the lid configured to close the fastening tool insertion portion is provided on the fastening tool insertion portion, liquid such as paint is prevented from entering the head housing portion from the fastening tool insertion portion. The lid may be configured to open when the fastening tool is inserted into the fastening tool insertion portion and close when the fastening tool is removed. For example, the lid may be configured to be resiliently deformed when the fastening tool is inserted into the hole. Also, a configuration in which the fastening tool insertion portion is formed of an incision and the periphery of the incision is used as the lid is also applicable. Alternatively, the lid may be configured to be opened by moving the fastening tool by an operation to insert the fastening tool into the fastening tool insertion portion.

According to the sprinkler head of the embodiment disclosed here, a configuration in which the tongue portion has a deformable portion deformable by the rotating motion of the protecting cap is also applicable. In this configuration, the protecting cap may be rotated in one direction by the deformation of a positioning engaging portion even when the protecting cap is rotated with the paste secured to the side surface of the protecting cap, so that the protecting cap may be demounted without giving damage to the paste.

The invention realizes the sprinkler head provided with the protecting cap of the embodiments disclosed here. Accordingly, the sprinkler head body may be connected to the water supply pipe in a state in which the protecting cap is mounted on the sprinkler head body, and hence the adhesion of the paint on the inner peripheral portion of the cylindrical member at the time of painting the ceiling surface may be prevented.

As described above, according to the invention, a protecting cap which allows engagement with a fastening tool in a state in which a protecting cap is mounted on a concealed-type sprinkler head, prevents adhesion of paint on an inner peripheral portion of a cylindrical member, and alleviates a burden of an operator, and a sprinkler head on which the protecting cap may be mounted is realized.

DETAILED DESCRIPTION OF THE INVENTION

First Embodiment (FIG. 1 to FIG. 9)

A sprinkler head SH of a first embodiment has substantially the same configuration as a sprinkler head disclosed in WO2011/125169. In this specification, only parts relating to the invention are described and description of other portions will be omitted.

Figure 1:
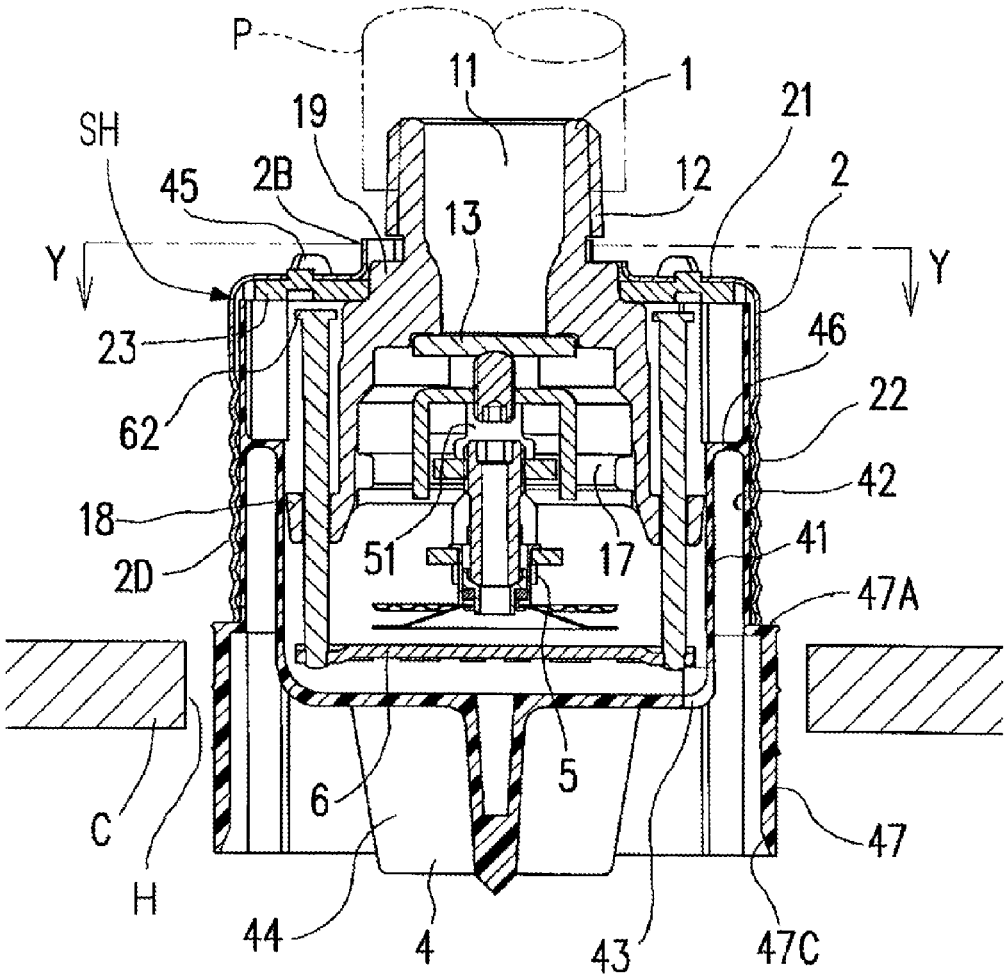
FIG. 1 is a cross-sectional view of a sprinkler head and a protecting cap of a first embodiment.
Figure 2:
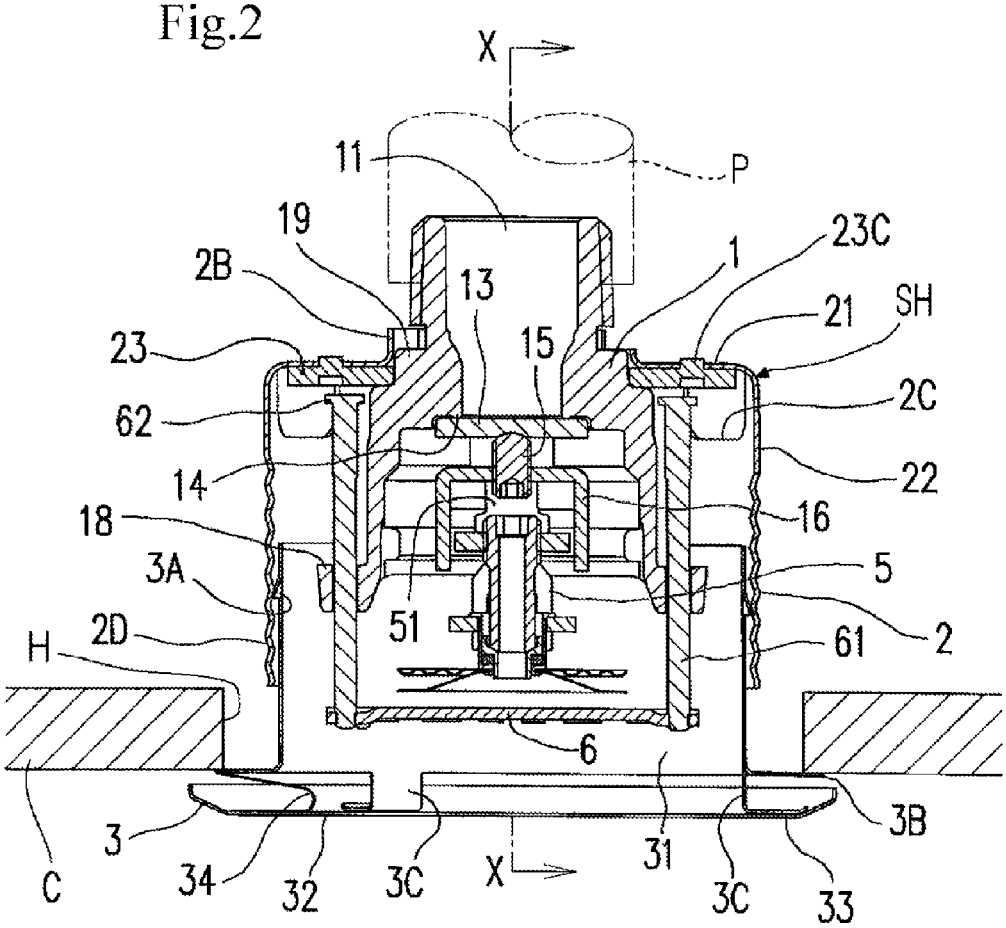
FIG. 2 is a cross-sectional view on which a cover plate unit is mounted on the sprinkler head in FIG. 1.

The sprinkler head SH illustrated in FIG. 1 includes a sprinkler head body 1, a cylindrical member 2, a cover plate unit 3, and a protecting cap 4.

The sprinkler head body 1 has a cylindrical shape and is provided with a nozzle 11 configured to discharge water supplied from a water supply pipe P in the interior thereof. The nozzle 11 is provided with a female screw 12 to be connected to the water supply pipe P on one end side thereof, and an end surface on the other end side corresponds to a valve seat 14 against which a valve body 13 configured to close the nozzle 11 abuts.

Figure 3:
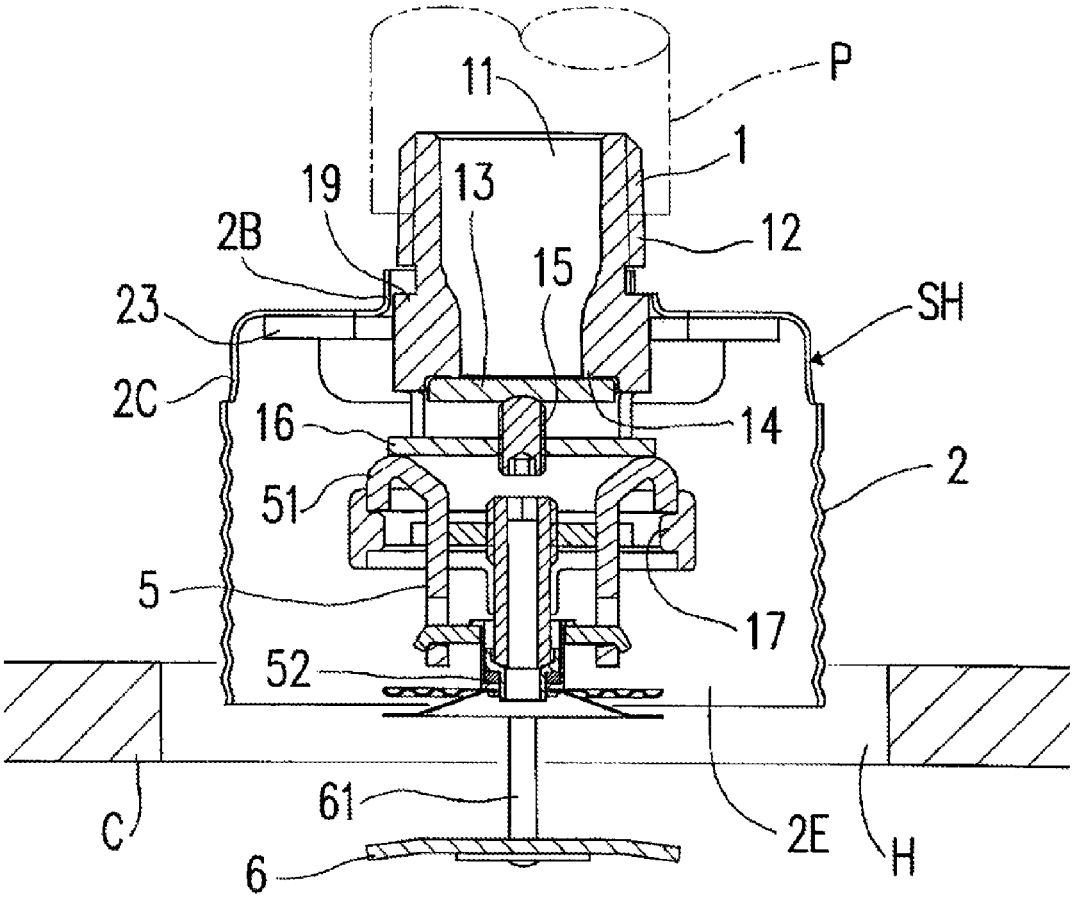
FIG. 3 is a cross-sectional view taken along the line X-X in FIG. 2 (the cover plate unit is removed).

The valve body 13 has a disk shaped and one end surface thereof is brought into abutment with the valve seat 14 of the nozzle 11 as described above. The surface on the opposite side is pressed against the valve seat 14 by a compression screw 15. The compression screw 15 is screwed into a female screw of a plate-shaped saddle 16. A heat-sensitive breakdown portion 5 is mounted below the saddle 16 and, as illustrated in FIG. 3, an end of a lever 51 of the heat-sensitive breakdown portion 5 is locked to a shoulder portion 17 formed inside of a cylindrical portion extending from an outer peripheral portion of the sprinkler head body 1 in the discharging direction of the nozzle 11.

Accordingly, if the compression screw 15 is driven into the saddle 16 and a distal end of the compression screw 15 is moved toward the valve body 13, the valve body 13 is pressed toward the valve seat 14, and the end of the lever 51 of the heat-sensitive breakdown portion 5 arranged below the saddle 16 is pressed toward the shoulder portion 17 of the sprinkler head body 1. The nozzle 11 is closed by the valve body 13, and a load is applied to the heat-sensitive breakdown portion 5.

A fusible alloy 52 is assembled in the interior of the heat-sensitive breakdown portion 5, and if the fusible alloy 52 is melt by heat in case of fire, the heat-sensitive breakdown portion 5 is disassembled and components such as the lever 51 are discharged to the outside of the sprinkler head body 1. When the heat-sensitive breakdown portion 5 is disassembled, the saddle 16, the compression screw 15, and the valve body 13 drop and the nozzle 11 is opened. Since the configuration of the heat-sensitive breakdown portion 5 is known and is described in detail in Japanese Unexamined Patent Application Publication No. 7-294545, description is omitted in this specification.

A plate-shaped deflector 6 is mounted on an extended line in the water discharge direction of the nozzle 11. The deflector 6 is fixedly mounted on a lower end side of a pin 61 being inserted into the hole of a projection 18 formed on the outside of the sprinkler head body 1, whereby a flange portion 62 formed on an upper end side of the pin 61 may be locked to an upper surface of the projection 18. The deflector 6 has a function to cause water discharged from the nozzle 11 hit thereon to fly in all directions.

The cylindrical member 2 is formed into a cylindrical shape, and the sprinkler head body 1 is housed in the cylindrical member 2. The cylindrical member 2 is formed with a flat surface 21 on one end side thereof, and is locked so as to rotate together with the sprinkler head body 1. More specifically, a hole 21A having the same shape as the outline of a polygonal portion 19 formed at a base portion of the female screw 12 is formed in the flat surface 21, and the polygonal portion 19 and the hole 21A are fitted to each other. An extending portion 2B rising along the side surface of the polygonal portion 19 is formed at a peripheral edge of the hole 21A. The extending portion 2B is bent at a distal end of the extending portion 2B after having fitted onto the polygonal portion 19 inward of the hexagonal hole 21A, so that the cylindrical member 2 is fixedly mounted on the sprinkler head body 1.

A plurality of openings 2C are formed from the flat surface 21 to a side surface 22 of the cylindrical member 2. The openings 2C have the same shape and are arranged at regular intervals.

The openings 2C are arranged at regular intervals on a peripheral edge of the flat surface 21, and the openings 2C are provided at six positions in the embodiment disclosed here.

Figure 4:
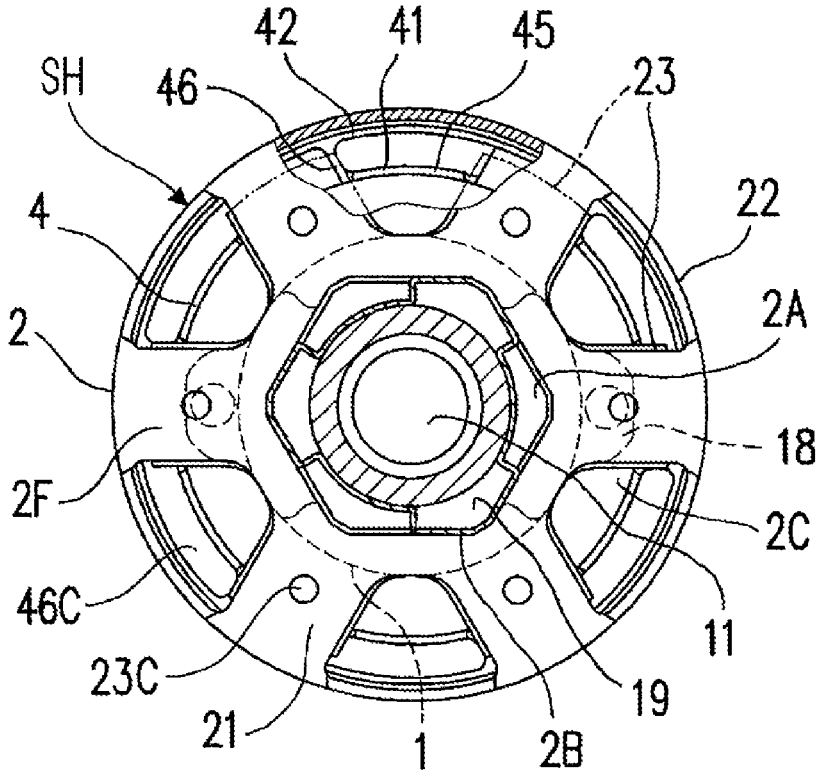
FIG. 4 is a cross-sectional view taken along the line Y-Y in FIG. 1 (part of the cylindrical member is illustrated in cross section).

A support base 23 is mounted on the flat surface 21 as an engaging portion with respect to fastening tool R described later. The support base 23 is formed into a plate shape, is formed with a hole having the same shape as the hole 21A at the center thereof, and is inserted into the polygonal portion 19 as illustrated in FIG. 4. The outline of the support base 23 is notched in a shape along edges of the openings 2C. The support base 23 is formed with projections 23C projecting from the flat surface 21 side, and the projections 23C engage holes formed through a beam portion 2F formed between adjacent openings 2C, so that the cylindrical member 2 and the support base 23 are capable of rotating together.

In the embodiment disclosed here, the support base 23 is mounted inside the flat surface 21. However, the support base 23 is not limited thereto and may be mounted on the outside of the flat surface 21.

By the support base 23 provided therebetween, an excessive load is applied to the cylindrical member 2 when the sprinkler head SH is mounted and demounted with respect to the water supply pipe by a fastening tool R, described later, so that the openings 2C (edges of the beam portions 2F) as a fastening tool engaging portion may be prevented from being deformed and damaged. In addition, by reinforcing the fastening tool engaging portion with the support base 23, the cylindrical member 2 may be formed to be thin.

In order to obtain the same effect as described above without installing the support base 23, if the edges of the openings 2C are bent to provide edge portions extending upright or if the upright portions are bent toward the beam portions 2F between the openings 2C, the strength of the edge portions of the openings 2C is improved. Also, the beam portions 2F may be formed with reinforcing ribs directed from the vicinity of the hole 2A of the cylindrical member 2 toward the edge of the flat surface 21 for preventing deformation of the beam portions 2F when mounting and demounting the sprinkler head SH with respect to the water supply pipe by the fastening tool R. In this manner, when the support base 23 is eliminated from the configuration described above, the edges of the openings 2C serve as the engaging portions with respect to the protecting cap 4.

The cylindrical member 2 is formed with a helical groove 2D on the side surface 22 as connecting means with respect to a retainer 31. The helical groove 2D may be formed by a rolling process by making the cylindrical member 2 a thin member. The helical groove 2D is engaged with a projection 3A formed on the outer peripheral surface of the retainer 31 by screwing, so that the heightwise position of the cover plate unit 3 may be adjusted. A lower portion of the cylindrical member 2 is an opening 2E.

The cover plate unit 3 includes the retainer 31 and a cover plate 32. The retainer 31 is connected to the cylindrical member 2 as described above. The retainer 31 has a cylindrical shape and is provided with the projection 3A formed by bending obliquely downward on the outer peripheral surface thereof. A flange portion 3B is formed at a lower end of the retainer 31. In addition, a plurality of legs 3C are formed so as to extend downward from the flange portion 3B.

Distal ends of the legs 3C are bent in substantially parallel to the flange portion 3B and is formed with a connecting surface 3D with respect to the cover plate 32. A fusible alloy 33 is interposed between the connecting surface 3D and the cover plate 32 and the cover plate 32 and the connecting surface 3D are joined by the fusible alloy 33.

Since a fusible alloy 33 is melted by heat and releases the cover plate 32, the melting temperature of the fusible alloy 33 is selected so as to melt at a temperature lower than the temperature at which a fusible alloy 52 assembled into the heat-sensitive breakdown portion 5 is melted.

The cover plate 32 is a disk-shaped thin plate and the peripheral edge is bent toward the retainer 31. A surface of the cover plate 32 opposite from a surface connected to the retainer 31 (the surface viewed from the room interior side) is decorated in substantially the same color as the color of a ceiling board C. As the material of the cover plate 32, copper or copper alloy having a good joining property with respect to the fusible alloy 33 are suitable. When a resilient member such as a leaf spring 34 is mounted between the cover plate 32 and the flange portion 3B of the retainer 31, the cover plate 32 is encouraged to drop when the fusible alloy 33 in case of fire is melted.

The protecting cap 4 has a bottomed cylindrical shape having a bottom surface and a cylinder, and the cylinder includes an inner cylinder 41 and an outer cylinder 42 arranged on the outside of the inner cylinder 41. The inside of the inner cylinder 41 corresponds to a "head housing portion") and is configured to house the sprinkler head body 1 and the deflector 6 in the interior thereof. A space between the inner cylinder 41 and the outer cylinder 42 corresponds to a "fastening tool insertion portion", and the inner cylinder 41 functions as a "partition" which partitions the head housing portion and the fastening tool insertion portion".

A bottom surface 41A of the inner cylinder 41 is formed with a water drain hole 43, and the water drain hole 43 is formed three dimensionally by notching the inner cylinder 41 from a side surface 41B to the bottom surface 41A. Accordingly, surface tension of water is restrained and hence desirable water draining properties are provided. In order to further improve the water draining properties, the bottom surface 41A may be formed as an inclined surface having a downward gradient toward the water drain hole 43 as shown by a dot line in FIG. 5.

With the provision of the water drain hole 43 at an edge portion of the inner cylinder 41, when painting the ceiling board C, the paint is prevented from easily entering the water drain hole 43 by an expanded portion 47, described later, formed in the vicinity of the water drain hole 43.

A gripping portion 44 which enables an operation to mount and demount the protecting cap 4 with respect to the sprinkler head body 1 is formed on the outside of the bottom surface 41A. The gripping portion 44 has a three-vane shape, and a lower end thereof projects beyond a lower end of the outer cylinder 42.

Tongue portions 45 formed so as to extend from the inner cylinder 41 are formed at an end opposite from the bottom surface 41A. The tongue portion 45 is inserted into the openings 2C of the cylindrical member 2, and projects outward from an end surface of the outer cylinder 42. In the embodiment disclosed here, the tongue portions 45 are each inserted in each of the six openings 2C, and have a plate shape and have substantially a triangular shape in plan view. The tongue portions 45 have a function of "positioning engaging portions" configured to position the mounting position of the protecting cap 4 with respect to the sprinkler head body 1.

More specifically, coupling portions 46 configured to connect the inner cylinder 41 and the outer cylinder 42 are formed between the tongue portions 45 and 45, and are arranged so that the support base 23 is overlapped with the coupling portions 46 and the beam portions 2F as illustrated in FIG. 4 when the tongue portions 45 are inserted through the cylindrical member 2 so as to project from the openings 2C thereof. When distal end portions R1 of a fastening tool R are inserted from a lower end of the protecting cap 4 so as to move along an outer surface of the tongue portion 45 using the tongue portions 45 as a mark, the distal end portions R1 are engaged with the support cup 23 via side surfaces 46A of the coupling portions 46.

Figure 5:
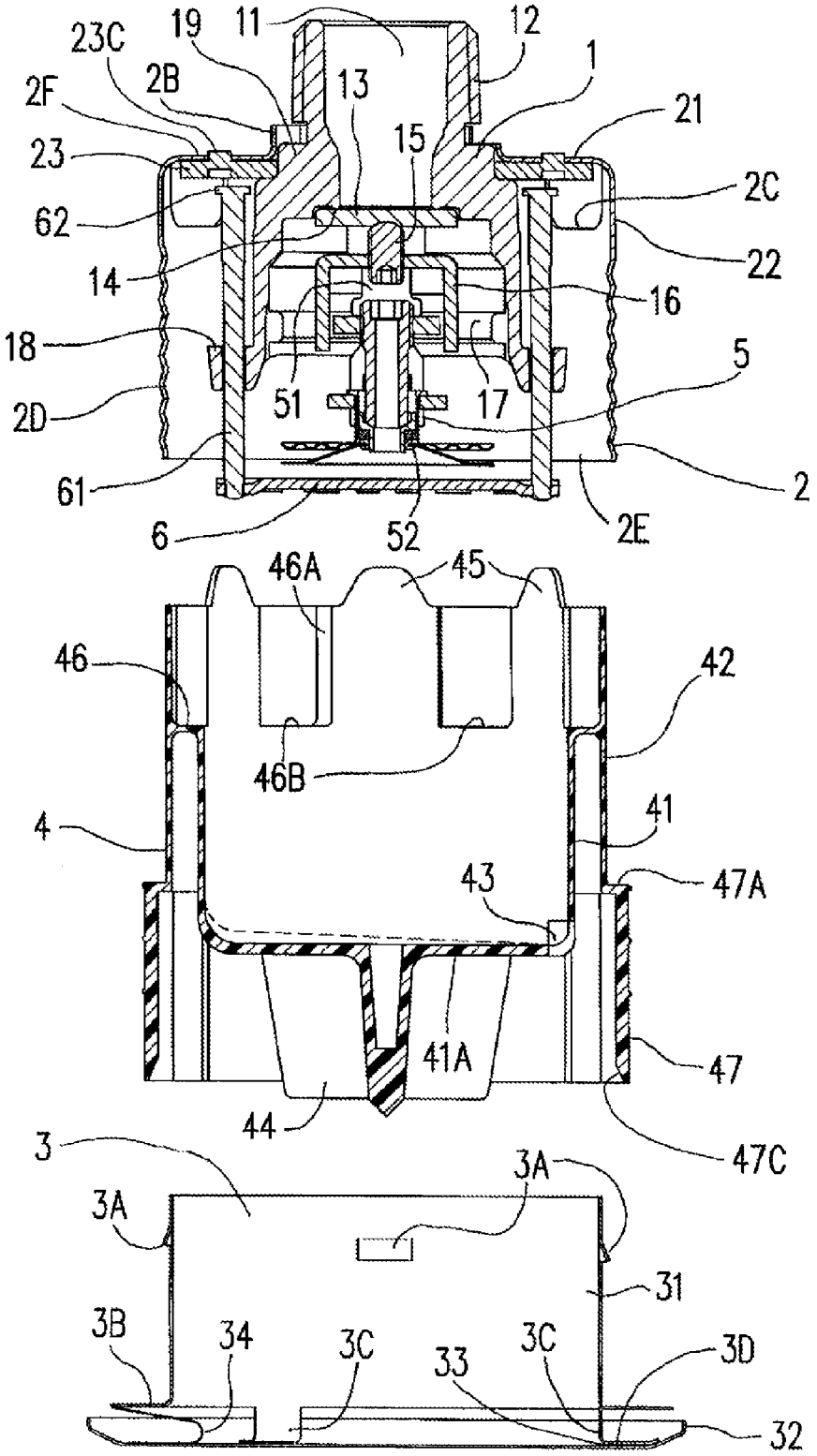
FIG. 5 is an exploded cross-sectional view of the sprinkler head, the protecting cap, and the cover plate unit.
Figure 6:
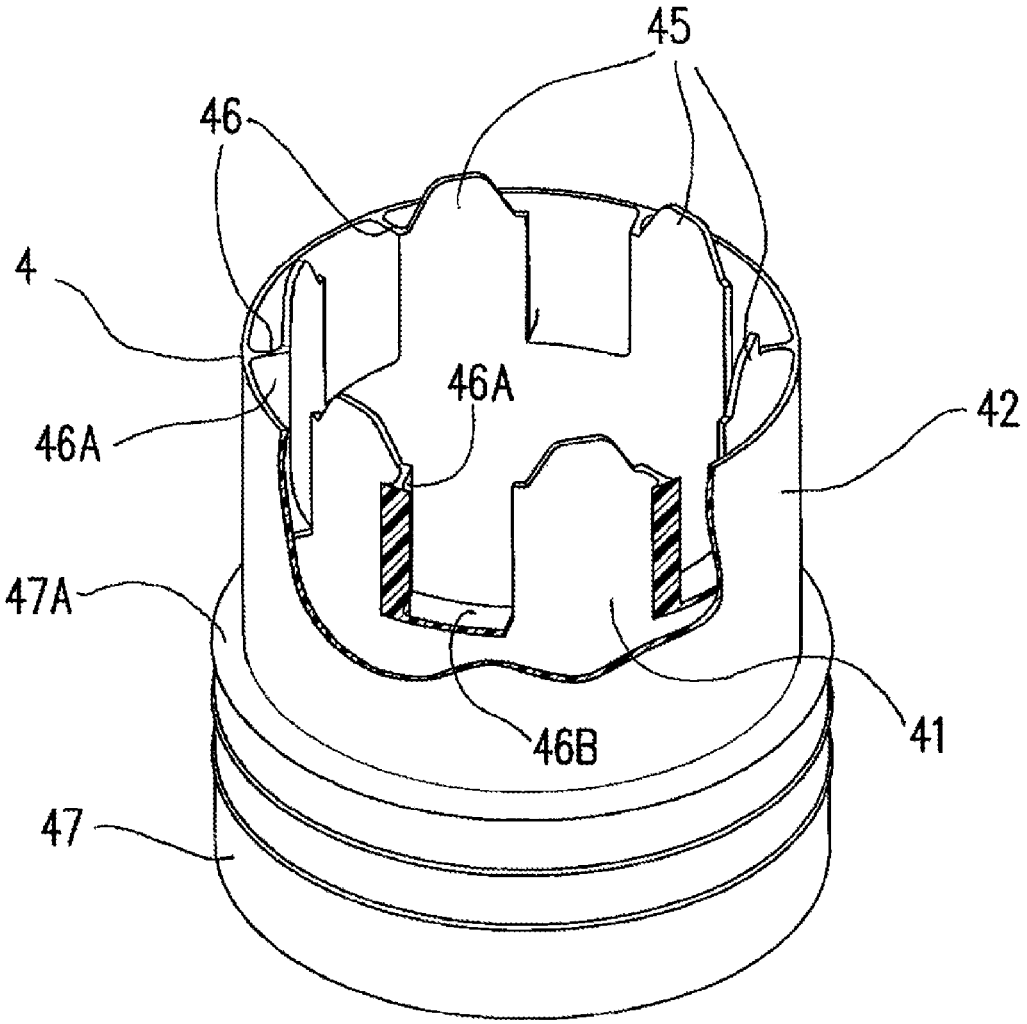
FIG. 6 is a perspective view of the protecting cap (a drawing from which part of an outer cylinder portion is removed).

The coupling portions 46 each have a side surface 46A and a bottom surface 46B, and the side surface 46A and the bottom surface 46B couple the inner cylinder 41 and the outer cylinder 42. In FIG. 5 and FIG. 6, only one side surface 46A is formed for one bottom surface 46B. The embodiment disclosed here is not limited thereto, and the side surface may be formed on the side facing the side surface 46A.

The side surfaces 46A and the bottom surfaces 46B of the coupling portions 46 have a function of the guide portion to guide the fastening tool R described later to the support base 23 as a fastening tool engaging portion of the sprinkler head body 1. More specifically, the distal end portions R1 of the fastening tool R have a width which allows passage between the coupling portions 46 and 46 and has a length which allows engagement with the support base 23. The distal end portions R1 of the fastening tool R to be inserted from the bottom surface 41A side of the inner cylinder 41 cannot be inserted further inward when coming into abutment with the bottom surface 46B of the coupling portion, and the protecting cap 4 does not rotate together even when the fastening tool R is rotated. Therefore, the operator determines that the engagement between the fastening tool R and the protecting cap 4 is not sufficient, and rotates the fastening tool R while pressing the same inward of the protecting cap 4, so that the fastening tool R is guided to a through space 46C in the vicinity of the side surface 46A. In a state in which the distal end portions R1 of the fastening tool R are in abutment with the side surface 46A, the distal end portions R1 are engaged with the edges of the openings 2C and the support base 23, so that the sprinkler head body 1 and the fastening tool R are rotated together.

It is also possible to form inclined surfaces between the side surfaces 46A and the bottom surface 46B so as to allow easy guiding of the fastening tool R into the through spaces 46C between the coupling portions 46 and 46 adjacent to each other.

The coupling portions 46 are formed so as to connect the inner cylinder 41 and the outer cylinder 42. Although the coupling portions 46 may be formed so as to fill the space between the inner cylinder 41 and the outer cylinder 42 completely, if it is configured so, the outer cylinder 42 may hardly be deformed with respect to the inner cylinder 41, and hence the protecting cap 4 may hardly be disconnected from the cylindrical member 2. In contrast, when the coupling portions 46 are formed partly so as to form the through spaces 46C penetrating from one end side to the other end side of the protecting cap 4 between the inner cylinder 41 and the outer cylinder 42, the outer cylinder 42 may easily be deformed toward the inner cylinder 41 owing to the presence of the through spaces 46C, whereby the outer cylinder 42 is flexibly deformed toward the inner cylinder, and hence the protecting cap 4 may easily be demounted from the cylindrical member 2.

The through spaces 46C and the tongue portions 45 described above are arranged on straight lines L parallel to a center axis of the protecting cap 4. Accordingly, when the distal ends R1 of the fastening tool R are inserted between the inner cylinder 41 and the outer cylinder 42 from the bottom surface 41A side of the protecting cap 4 using the tongue portions 45 as a mark, the distal ends R1 pass through the through spaces 46C and arranged along the tongue portions 45 so that the distal ends R1 are set to positions where engagement with the support base 23 are enabled.

The outer diameter of the outer cylinder 42 is formed to be substantially the same as or slightly smaller than an inner diameter of the cylindrical member 2, so that the outer cylinder 42 and the cylindrical member 2 are capable of fitting each other. By fitting the outer cylinder 42 and the cylindrical member 2, the adhesion of the paint on an inner peripheral portion of the cylindrical member 2 when painting the ceiling may be prevented. The outer cylinder 42 is configured to cover the helical groove 2D on the inner peripheral side of the cylindrical member 2 when the protecting cap 4 is engaged with the cylindrical member 2.

The expanded portion 47 having a diameter substantially the same as or slightly larger than the outer diameter of the cylindrical member 2 is formed on a lower portion of the outer cylinder 42 in the vicinity of the bottom surface 41A of the inner cylinder 41. A boundary between the expanded portion 47 and the outer cylinder 42 is formed as a step 47A, and a lower end of the cylindrical member 2 is brought into abutment with the step 47A. Accordingly, when filling a peripheral edge of a hole H formed in the ceiling board C so as to allow insertion of the sprinkler head SH with paste, a portion between an outer peripheral portion of the expanded portion 47 and an inner peripheral portion of the hole H is filled with the paste, and entry or adhesion of the paste to the interior of the cylindrical member 2 may be prevented.

Figure 7:
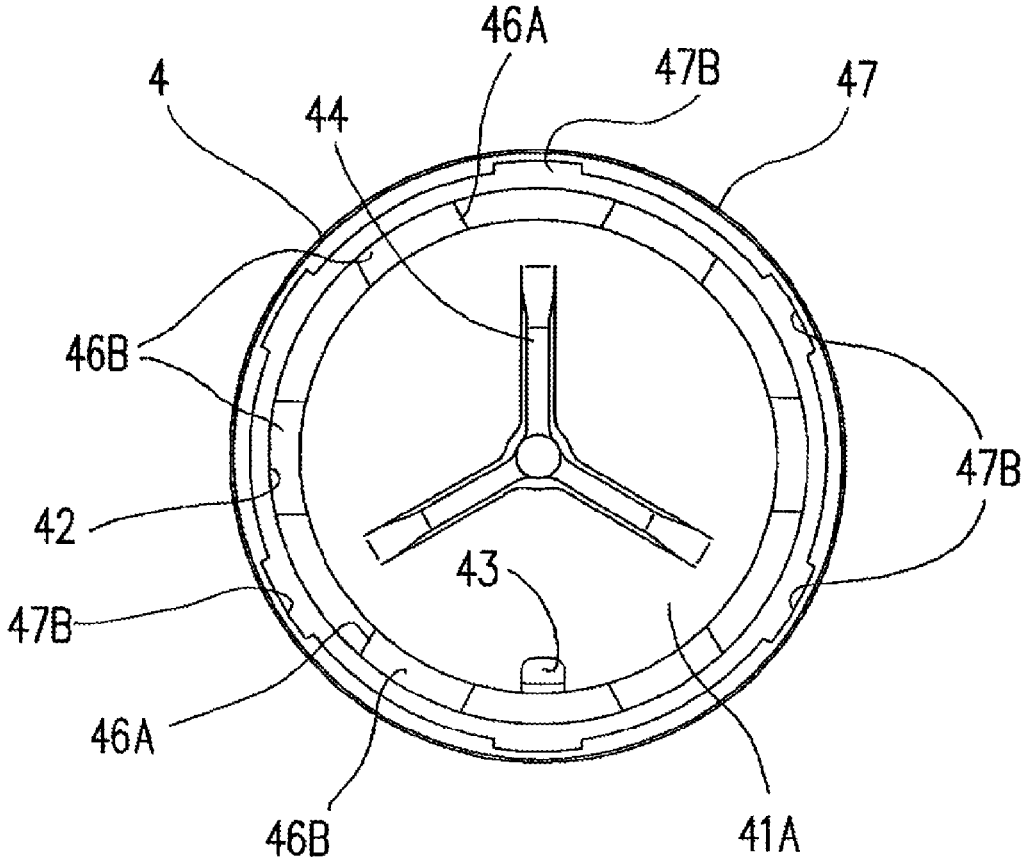
FIG. 7 is a bottom view of the protecting cap.

The expanded portion 47 and the fastening tool R are each provided with markings used when inserting the distal ends R1 of the fastening tool R into the protecting cap 4. Specifically, the expanded portion 47 is provided with grooves 47B on the inside thereof. The grooves 47B are engageable with projections R2 formed on an outer peripheral surface of the fastening tool R on rather the bottom surface side with respect to the distal ends R1. As illustrated in FIG. 7, the grooves 47B are visible from the bottom surface of the protecting cap 4. In addition, the grooves 47B are formed at positions in directions where the distal ends of the gripping portion 44 having a three-vane shape viewed from the bottom surface 41A side are directed. Accordingly, when the grooves 47B are hardly visible in a dark environment, the distal ends R1 of the fastening tool R may be inserted into the grooves 47B by using the distal end positions of the gripping portion 44 as marks. An inclined surface 47C is formed at a lower end on the inside of the expanded portion 47 so as to allow easy insertion of the fastening tool R into the interior of the expanded portion 47.

Figure 8:
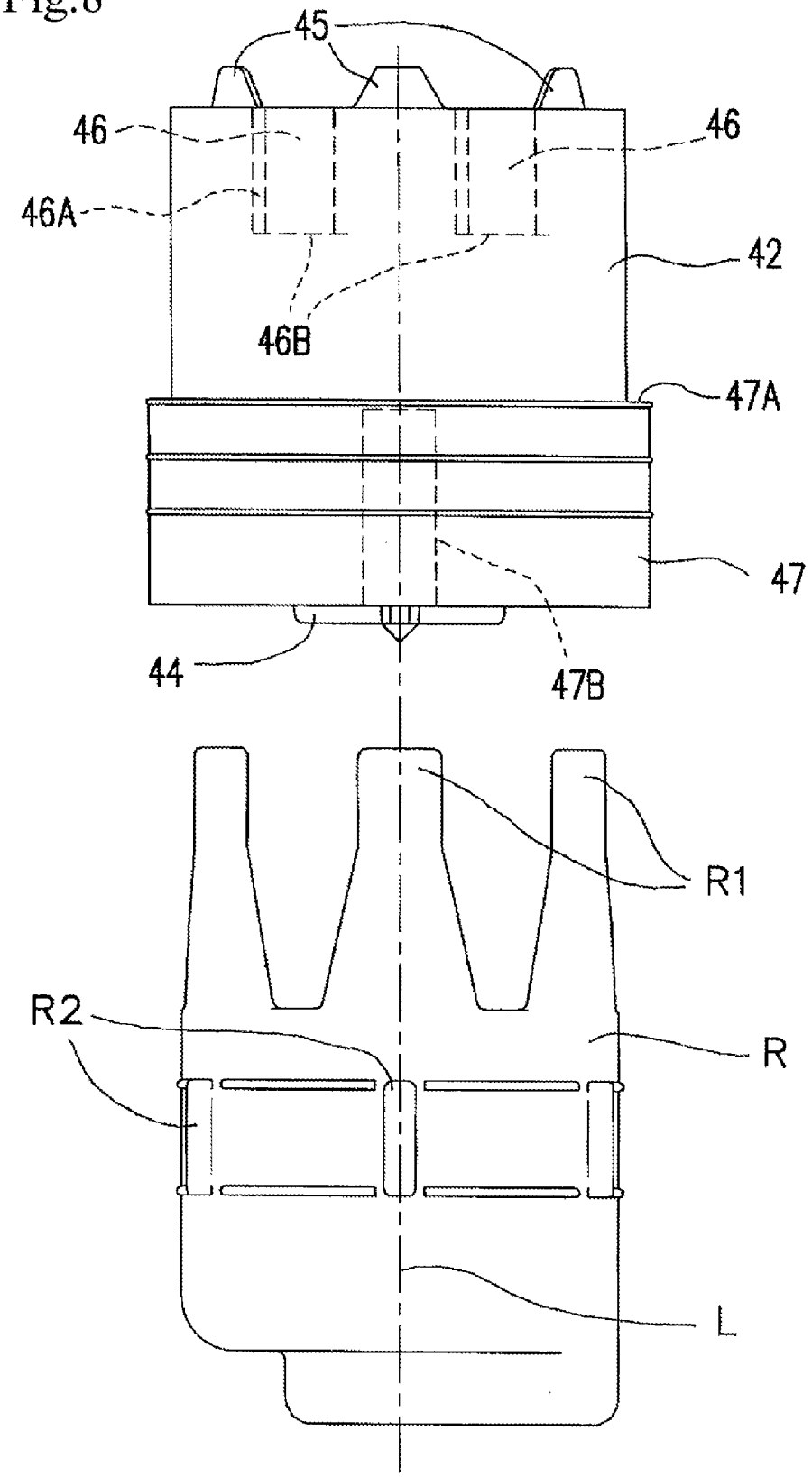
FIG. 8 is a side view of the protecting cap and a fastening tool.
Figure 9:
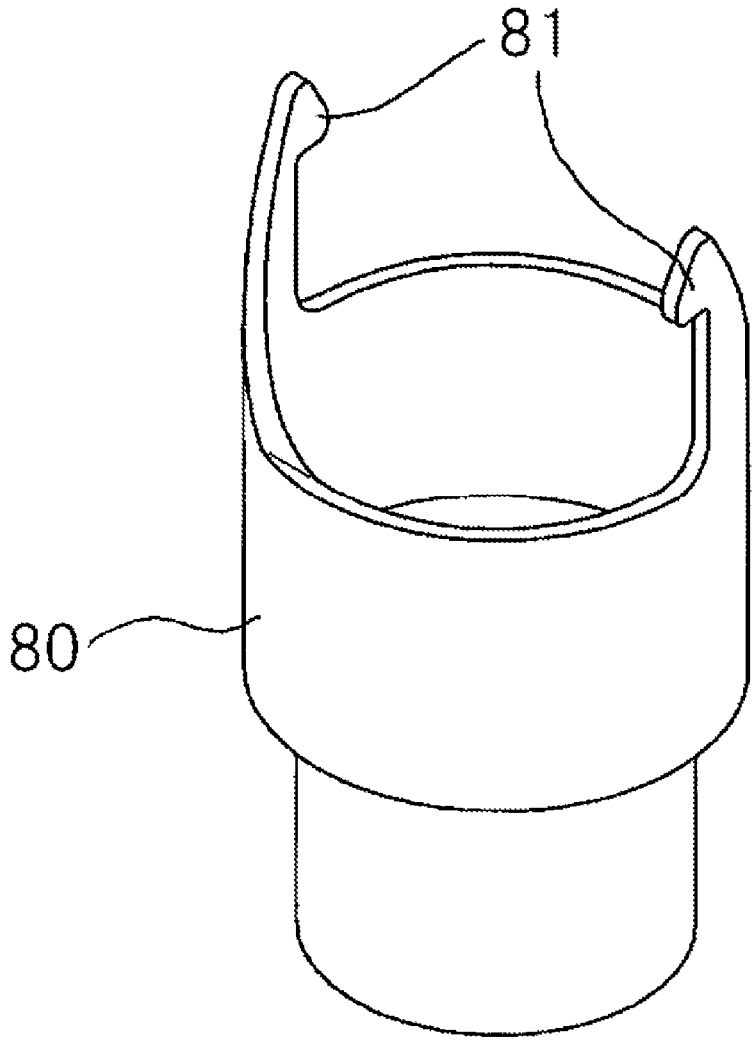
FIG. 9 is a perspective view of a protecting cap demounting tool.

As illustrated in FIG. 8, the distal ends R1 and the projections R2 of the fastening tool R are aligned on the straight lines L, and the through spaces 46C between the coupling portions 46 and 46 adjacent to the grooves 47B and the tongue portions 45 are also aligned on the lines L. Accordingly, when the distal ends R1 of the fastening tool R are inserted between the inner cylinder 41 and the outer cylinder 42 using the grooves 47B as marks, the distal ends R1 are inserted into the through spaces 46C between the coupling portions 46 and 46 and the distal ends R1 are arranged along the tongue portions 45, whereby the projections R2 are housed in the grooves 47B. Ends on the side of the distal ends R1 of the projections R2 are engaged with the inside of the step 47A of the expanded portion 47 to restrict an insertable range of the fastening tool R with respect to the protecting cap 4. In contrast, when the projections R2 are not housed in the expanded portion 47, it indicates that the distal ends R1 of the fastening tool R are not correctly inserted between the coupling portions 46 and 46 of the protecting cap 4, which allows the operator to recognize whether or not the state of engagement between the protecting cap 4 and the fastening tool R is correct.

A marking which indicates a mounting range of the concealed-type sprinkler head SH with respect to the position of the lower surface of the ceiling is provided on an outer peripheral surface of the expanded portion 47. The marking is indicated by three lines, in which a line at the center indicates a mounting reference position, and upper and lower lines indicate positions of limitation of the mounting range.

The lower end of the expanded portion 47 projects downward beyond a lower end of the inner cylinder 41 (the bottom surface 41A). When filling the periphery of the outer peripheral surface of the expanded portion 47 with paste, adhesion of the paste to the bottom surface 41A is prevented by the expanded portion 47. In addition, after the paste has dried, the protecting cap 4 may be rotated in the circumferential direction or moved downward by gripping the gripping portion 44 provided on the bottom surface 41A.

Subsequently, a procedure of installation of the concealed-type sprinkler head SH described above will be described.

The concealed-type sprinkler head SH is in a state in which the protecting cap 4 is fitted on the cylindrical member 2, and the cylindrical member 2 and the cover plate unit 3 are delivered in a separate state.

First of all, the concealed-type sprinkler head SH is connected to the water supply pipe P. In a state in which the protecting cap 4 is fitted on the cylindrical member 2, the fastening tool R is inserted between the inner cylinder 41 and the outer cylinder 42 of the protecting cap 4. At this time, when the distal ends R1 of the fastening tool R are aligned with the positions of the grooves 47B of the protecting cap 4 and inserted therein, the distal ends R1 are guided between the coupling portions 46 and 46 and hence insertion is smoothly achieved. In addition, in a case where the distal ends R1 of the fastening tool R are inserted into the protecting cap 4 without confirming the grooves 47B, the distal ends R1 may be guided between the coupling portions 46 and 46 by rotating the fastening tool R so as to avoid the interference with the distal ends R1 of the fastening tool R with respect to the bottom surface 46B of the coupling portions 46. Accordingly, the support base 23 and the distal ends R1 of the fastening tool R are engaged, and the fastening tool R is rotated and the female screw 12 of the sprinkler head body 1 is screwed into the water supply pipe P.

In the above-described description, the female screw 12 is screwed into the water supply pipe P after the fastening tool R has inserted into the protecting cap 4. Alternatively, however, a procedure of driving the female screw 12 into the water supply pipe P while holding the concealed-type sprinkler head SH with hand first, and after the female screw 12 has driven to some extent, inserting the fastening tool R into the protecting cap 4 and driving further inward is also possible.

As the next step, the ceiling board C is mounted. In the ceiling board C at a position where the concealed-type sprinkler head SH is mounted, the hole H is formed. After the ceiling board C is mounted, the expanded portion 47 of the protecting cap 4 projects from a lower surface of the ceiling board C.

Subsequently, the protecting cap 4 is demounted and the cover plate unit 3 is mounted in the cylindrical member 2, but the hole H for allowing insertion of the sprinkler head SH is formed in the ceiling board C in advance. Since the hole H is formed before the ceiling board C is fixed to a ceiling base member, there is a case where the hole H formed in the ceiling board C is shifted from the position of the sprinkler head SH installed in the ceiling. In such a case, a hole is formed at an adequate position of the ceiling board C, and the hole formed in advance is filled with paste. Then, the surface of the ceiling board C is painted by spray. At this time, since the inner peripheral portion of the cylindrical member 2 is covered with the outer cylinder 42, the paint is prevented from adhering on the inner peripheral portion of the cylindrical member 2.

Demounting of the protecting cap 4 is achieved by gripping the gripping portion 44 of the protecting cap 4 and pulling out downward, or gripping the expanded portion 47 and pulling out downward. Alternatively, the protecting cap 4 may be pulled out downward by using a cap demounting tool 80. At that time, when the above-described paste is adhered on the side surface of the protecting cap 4, the protecting cap 4 may hardly be pulled out. When an attempt is made to forcedly pulled out the protecting cap 4, the paste may be peeled and the closed hole may be exposed again.

Accordingly, by using the cap demounting tool 80 to demount the protecting cap 4, the protecting cap 4 may be demounted from the sprinkler head SH without giving damage to the paste. Specifically, claws 81 formed at distal ends of the cylindrical cap demounting tool 80 are inserted between the inner cylinder 41 and the outer cylinder 42 of the protecting cap 4. At that time, the claws 81 are inserted between the inner cylinder 41 and the outer cylinder 42 so as to move along the grooves 47B in the interior of the expanded portion 47. The claws 81 are inserted into the through spaces 46C between the two coupling portions 46 and 46, and the claws 81 engage the bottom surface 46B by rotating the cap demounting tool 80. The cap demounting tool 80 is rotated in the state in which the claws 81 are engaged with the bottom surface 46B and is moved little by little downward while changing the direction of rotation alternately. Then, the paste is peeled off from the side surface of the protecting cap 4. Now, the protecting cap 4 may be pulled out from the cylindrical member 2 by pulling the cap demounting tool 80 downward.

As a next process, the cover plate unit 3 is mounted in the cylindrical member 2. The projection 3A formed on the side surface of the retainer 31 is screwed into the helical groove 2D of the cylindrical member 2, and the flange portion 3B connected to a lower portion of the retainer 31 is adjusted to come to the position where the flange portion 3B comes into contact with the ceiling board C. Accordingly, a procedure of installation of the concealed-type sprinkler head SH is completed.

An operation of the sprinkler head is described in Japanese Unexamined Patent Application Publication No. 2011-218062 or Japanese Unexamined Patent Application Publication No. 7-284545, and hence description will be omitted.

Figure 10:
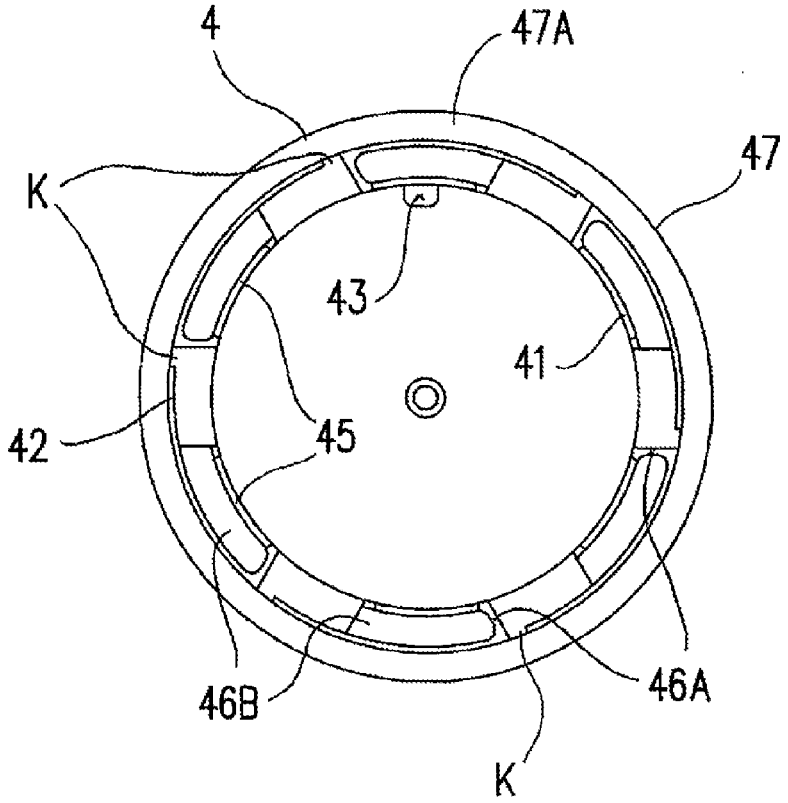
FIG. 10(*a*) is a plan view of Modification 1 of the first embodiment, and FIG. 10(*b*) is a side view of Modification 1 of the first embodiment.
Figure 10:
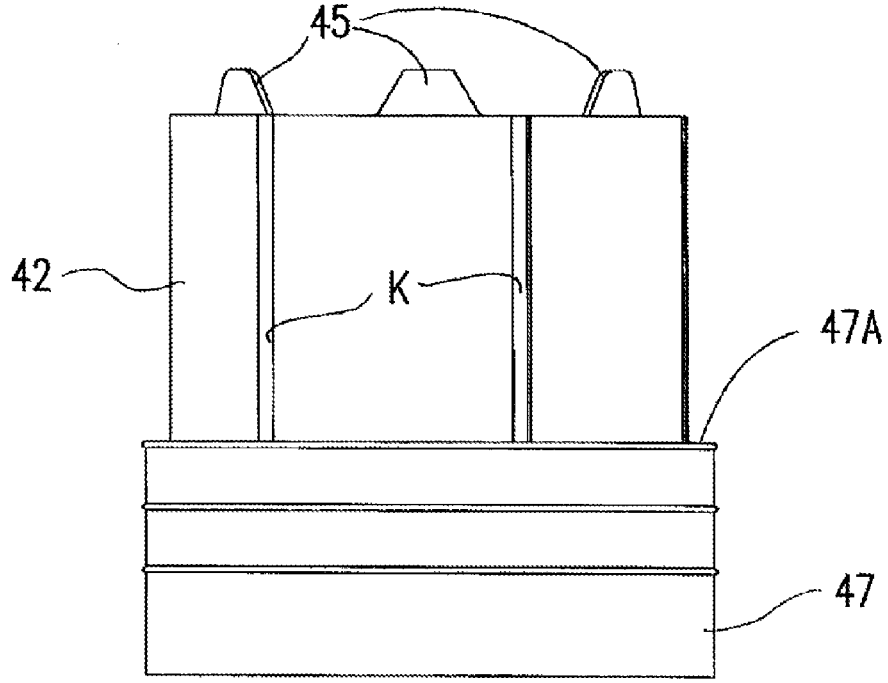
Figure 11:
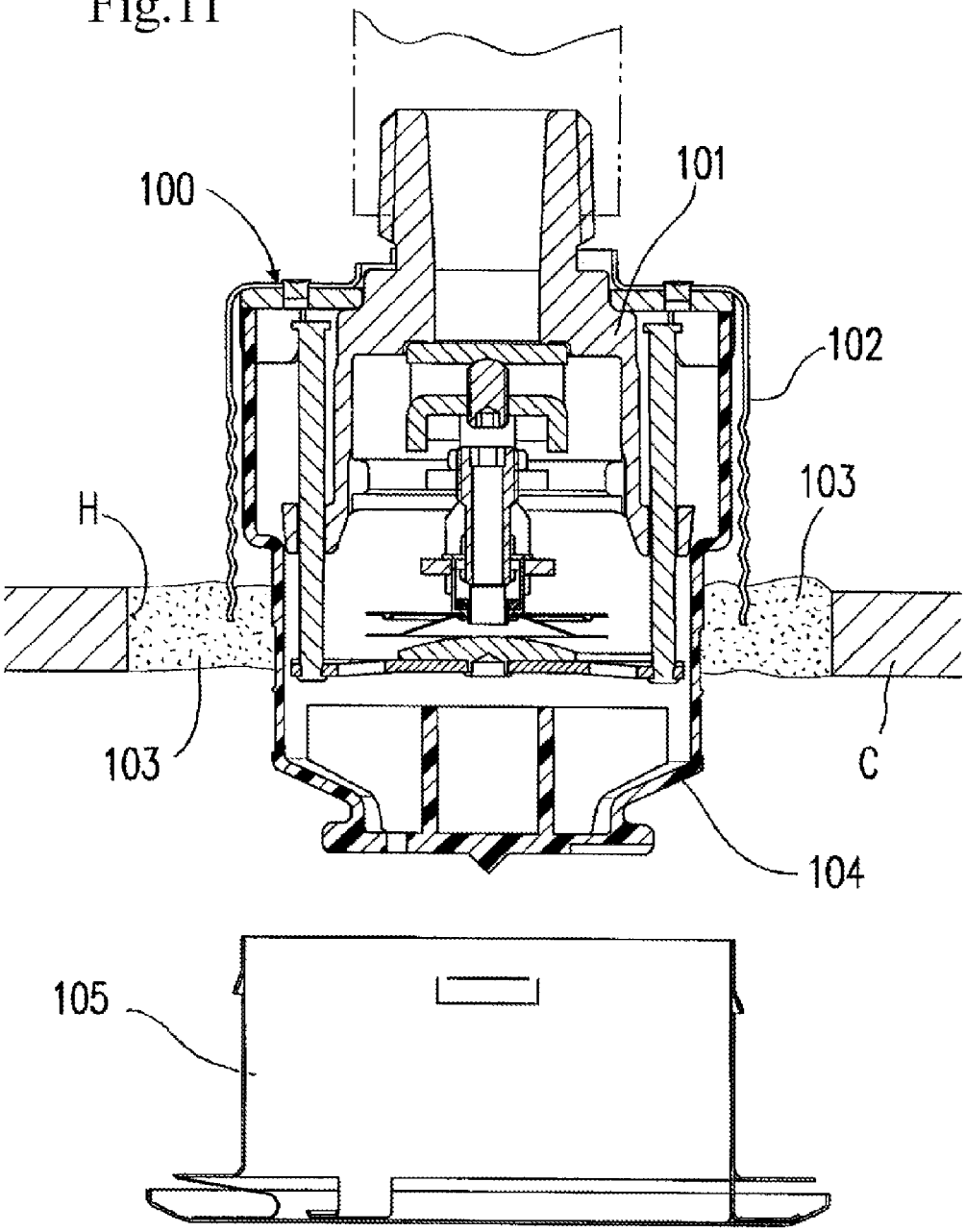
FIG. 11 is a cross-sectional view of a sprinkler head and a protecting cap of the related art.

Modification 1 of First Embodiment (FIG. 10)

The protecting cap illustrated in FIG. 10 is formed with notches K extending from an upper end of the outer cylinder 42 to the lower end of the protecting cap 4 of the first embodiment. The outer cylinder 42 is allowed to be resiliently deformed toward the inner cylinder 41 and the outer peripheral of the outer cylinder 42.

When the outer diameter of the outer cylinder 42 is set to be slightly larger than the inner diameter of the cylindrical member 2, the protecting cap 4 and the cylindrical member 2 are fitted in a state in which the outer cylinder 42 presses an inner peripheral surface of the cylindrical member 2 and the outer cylinder 42 is allowed to be resiliently deformed toward the inner cylinder 41 by the notches K, so that the inner peripheral portion of the cylindrical member 2 may be held by an outer peripheral portion of the outer cylinder 42 at an adequate pressing force. Accordingly, even though the protecting cap 4 is repeatedly mounted on and demounted from the cylindrical member 2, reduction of the force that the outer cylinder 42 of the protecting cap 4 presses the inner peripheral portion of the cylindrical member 2 may be restrained.

Also, since the opening 2E at the lower end of the cylindrical member 2 is closed by the expanded portion 47, adhesion of the paint to the interior of the cylindrical member 2 at the time of painting of the ceiling is prevented.

Figure 12:
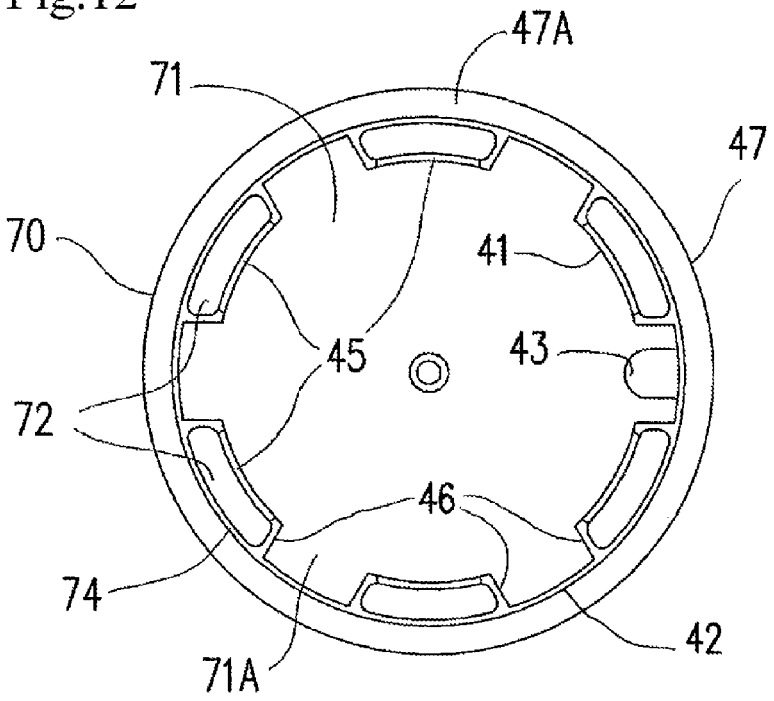
FIG. 12(*a*) is a plan view of Modification 2 of the first embodiment, and FIG. 12(*b*) is a side view of Modification 2 of the first embodiment.
Figure 12:
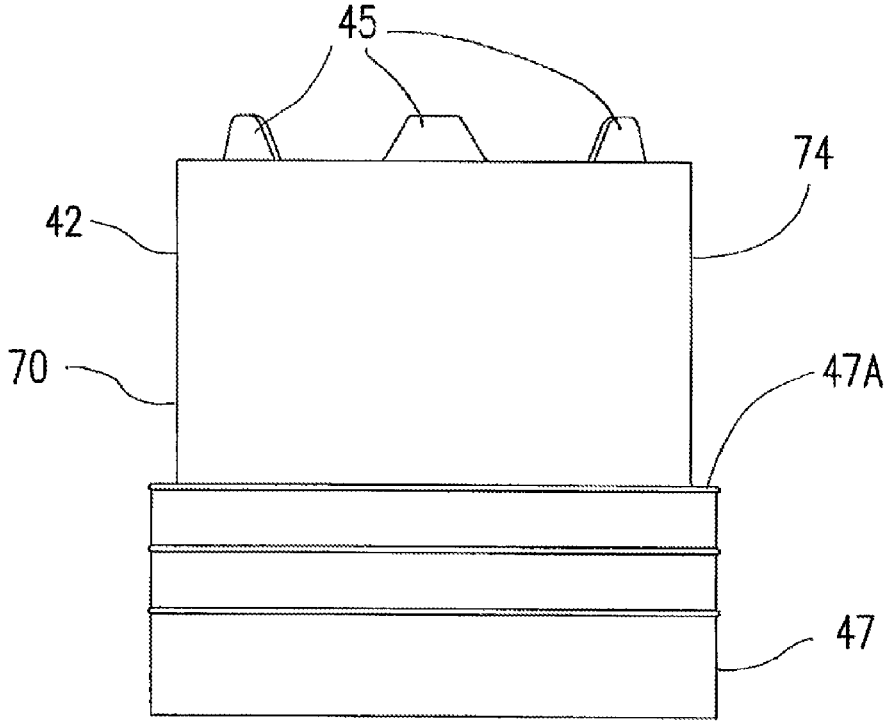

Modification 2 of First Embodiment (FIG. 12)

Modification 2 of the first embodiment illustrated in FIG. 12 includes a protecting cap 70 having a bottomed cylindrical shape, a head housing 71 configured to house the sprinkler head body 1 and the deflector 6 of the sprinkler head SH corresponds to the interior of the inner cylinder 41. The inner cylinder 41 includes notches notched in the vertical direction, the coupling portions 46 is provided at a notched end of the inner cylinder 41 and is coupled to the outer cylinder 42 as the outer peripheral portion. Then, a space surrounded by the coupling portions 46, the inner cylinder 41, and the outer cylinder 42 constitutes a fastening tool insertion portion 72.

A bottom surface 71A is formed with the water drain hole 43. The inner cylinder 41 is formed with the tongue portions 45 at an upper end of the inner cylinder 41 so as to project beyond an upper end side of the outer cylinder 42. An outer peripheral portion 74 of the protecting cap 70 is fitted to the interior of the cylindrical member 2. The tongue portions 45 are inserted into the openings 2C at that time.

When the fastening tool R is inserted into the fastening tool insertion portion 72, the distal ends R1 of the fastening tool R engages the support base 23 via the coupling portions 46, so that the fastening tool R and the sprinkler head body 1 are allowed to rotate together.

Figure 13:
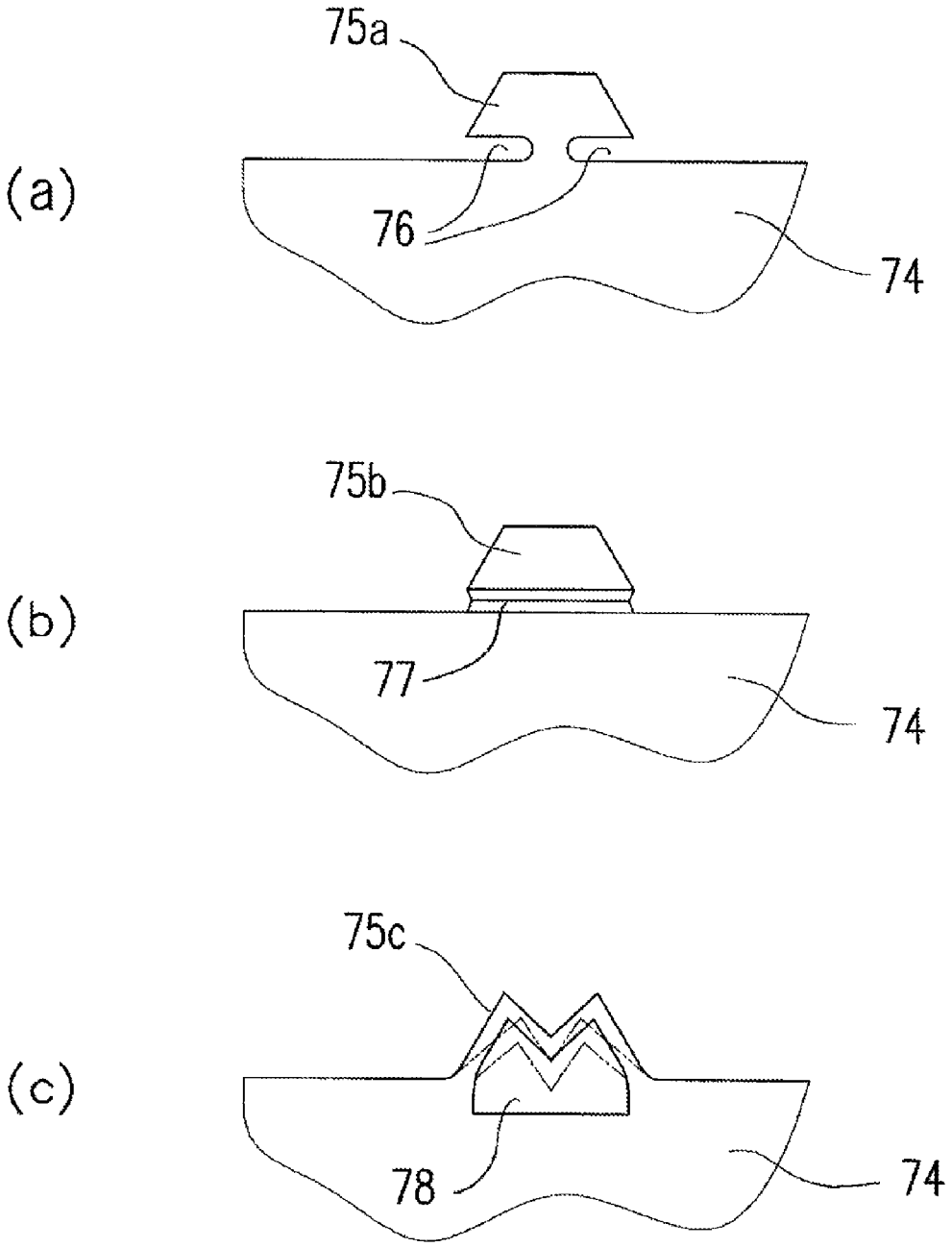
FIG. 13 is a modification of a tongue portion.

Modification 3 of First Embodiment (FIG. 13)

FIG. 13 is a modification of a tongue portion 75 and respective tongue portions 75*a* to 75*c* illustrated in FIG. 13(*a*) to FIG. 13(*c*) have a deformation allowing portion which may be deformed by the rotating motion of the protecting cap. FIG. 13(*a*) illustrates a mode in which incisions 76 are formed at a boundary between the tongue portion 75*a* and the outer peripheral portion 74. In this configuration, when the protecting cap 70 is rotated, the tongue portion 75*a* is bent to allow deformation or separation. FIG. 13(*b*) illustrates a mode in which a groove 77 is formed at a boundary between the tongue portion 75*b* and the outer peripheral portion 74. In this configuration, when the protecting cap 70 is rotated, the tongue portion 75*b* is separated from the outer peripheral portion 74 along the groove 77. FIG. 13(*c*) illustrates a mode in which an opening 78 along the outline of the tongue portion 75*c* is formed. In this configuration, easy deformation of the tongue portion 75*c* is achieved. When the tongue portion 75*c* receives a force sideway, the tongue portion 75*c* may be deformed into a shape indicated by a double-dashed chain line.

By the deformation of the tongue portions 75*a* to 75*c* described above, the protecting cap 70 may be rotated when demounting the protecting cap 70 from the cylindrical member 2.

In other words, according to modifications illustrated in FIG. 13, the protecting cap 70 may be rotated only in one direction by rotating the protecting cap 70 and deforming or separating the tongue portions 75*a* to 75*c*.

Figure 14:
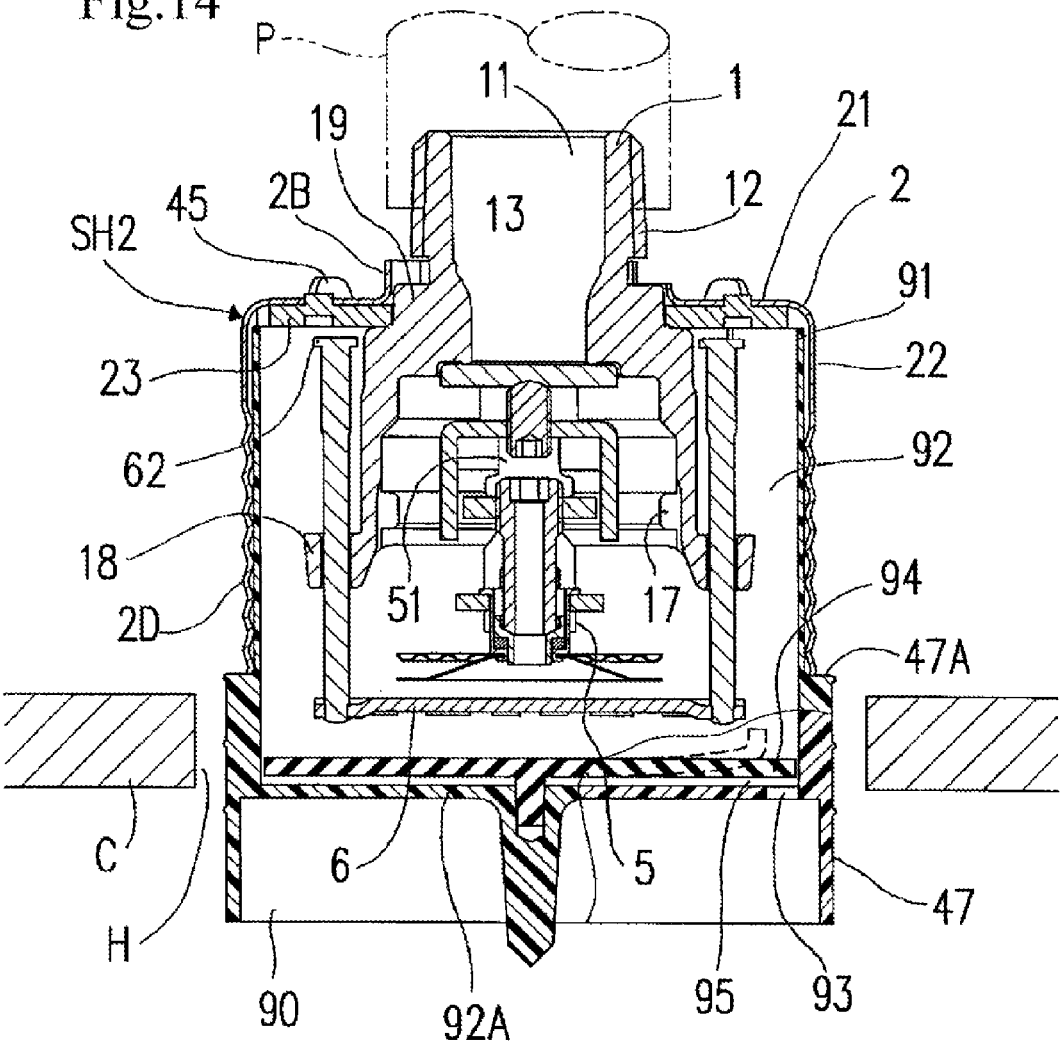
FIG. 14 is a cross-sectional view of a sprinkler head and a protecting cap of a second embodiment.
Figure 15:
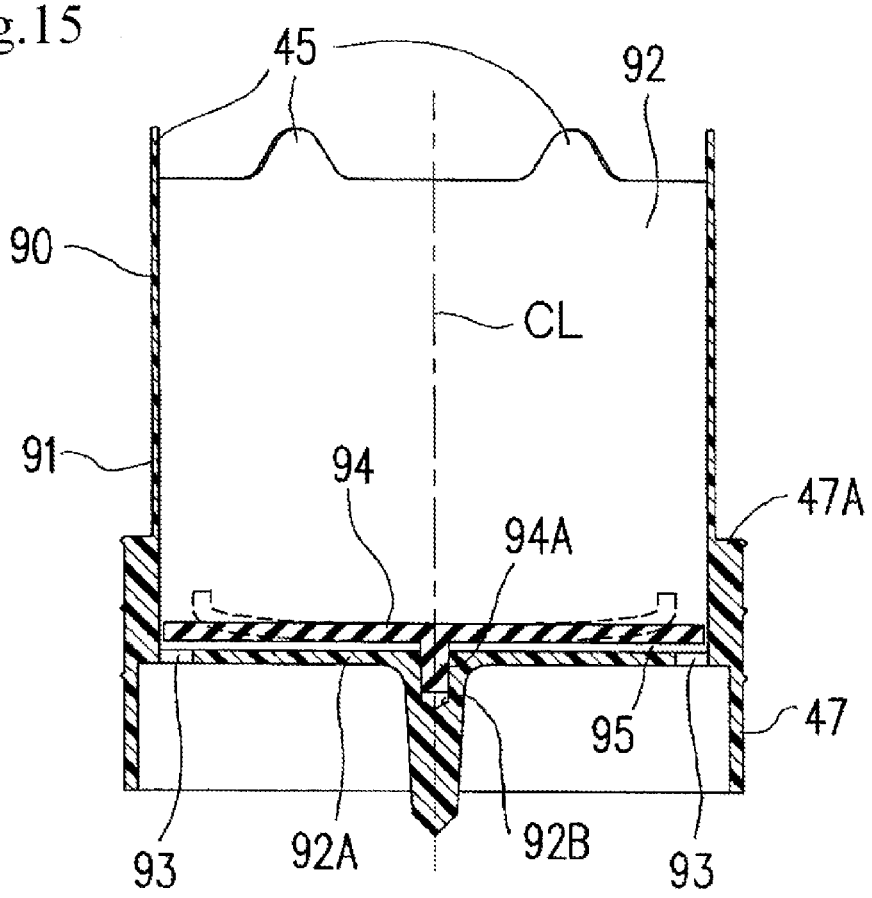
FIG. 15(*a*) is a cross-sectional view of the protecting cap of the second embodiment, and FIG. 15(*b*) is a bottom view of FIG. 15(*a*).
Figure 15:
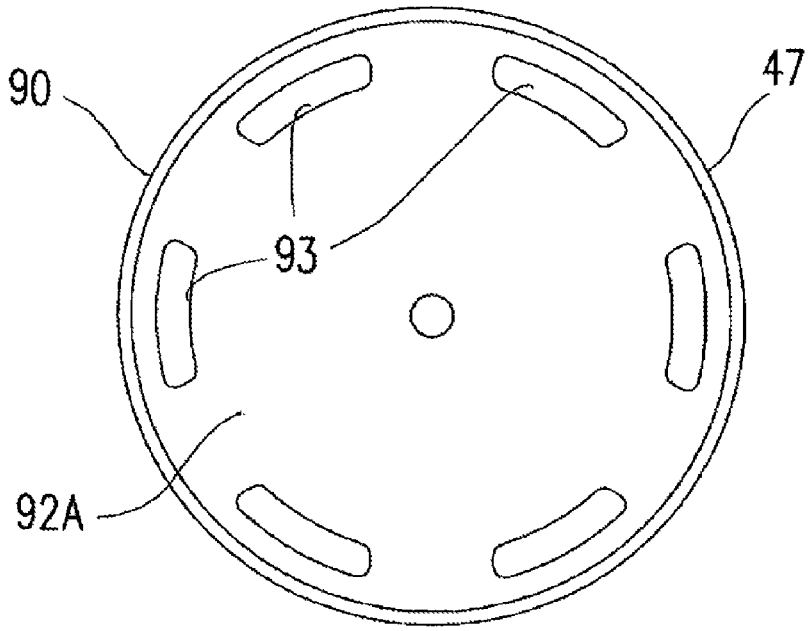

Second Embodiment (FIGS. 14 and 15)

A protecting cap 90 of a second embodiment is provided with a lid 94 at an inlet port of the fastening tool insertion portion of the protecting cap 90 so as to be openable and closable to prevent entry of paint into the interior of the protecting cap. In the second embodiment, parts having the same configuration as those in the first embodiment are designated by the same reference numerals and the description will be omitted.

A configuration of a sprinkler head SH2 of the second embodiment is the same as that of the first embodiment except for the protecting cap 90. The protecting cap 90 of the second embodiment has a bottomed cylindrical shape, and an outer peripheral portion 91 is fitted into the interior of the cylindrical member 2.

The interior of the protecting cap 90 corresponds to a head housing 92 in which the sprinkler head body 1 and the deflector 6 are housed, and a bottom surface 92A provided at a lower end side of the head housing 92 is formed with a plurality of holes 93, which corresponds to the "fastening tool insertion portions".

By inserting the distal ends R1 of the fastening tool R into the holes 93, guiding the distal ends R1 into the head housing 92, and engaging the distal ends R1 with the support base 23, which is an engaging portion with respect to the fastening tool R, the fastening tool R and the sprinkler head body 1 are allowed to be rotated together.

The lid 94 is provided in the vicinity of the holes 93, and normally closes the holes 93. The lid 94 has a flat-plate shape, and is mounted in the interior of the head housing 92. More specifically, the lid 94 is formed with a projecting portion 94A a center portion thereof, and the projecting portion 94A is inserted into a hole 92B formed at the center of the bottom surface 92A of the head housing 92. The lid 94 is formed of a member having resiliency such as rubber, and is deformable easily. The lid 94 has a shape having the holes 93 arranged at an edge portion of the lid 94.

When the distal ends R1 of the fastening tool R is inserted into the holes 93, the lid 94 is deformed upward by the distal ends R1 as shown by a dot line in FIG. 14, and the distal ends R1 of the fastening tool R is allowed to engage the support base 23 of the sprinkler head body 1. When the distal ends R1 of the fastening tool R is pulled out from the holes 93, the lid 94 is returned back to its original flat shape by the resiliency, so that the holes 93 are closed.

The protecting cap 90 is formed with the tongue portions 45 at an end on the opposite side of the bottom surface 92A so as to extend from an end of the outer peripheral portion 91. The tongue portions 45 and the holes 93 are arranged on a straight line parallel to a virtual centerline CL of the protecting cap. When fitting the protecting cap 90 into the interior of the cylindrical member 2, the tongue portions 45 are inserted into the openings 2C of the cylindrical member 2. Subsequently, when the distal ends R1 of the fastening tool R are inserted into the holes 93, the distal ends R1 are arranged along the tongue portions 45, so that the distal ends R1 may be engaged with the support base 23 having a shape extending along the edge portion of the openings 2C.

The protecting cap 90 of the second embodiment is not provided with the water drain hole 43 of the protecting cap 4 of the first embodiment. However, the protecting cap 90 includes a space 95 formed between the holes 93 and the lid 94, and hence the water in the head housing 92 flows out from the space 95 even when the lid 94 closes the holes 93. Therefore, the holes 93 have a function of the water drain hole.

Figure 16:
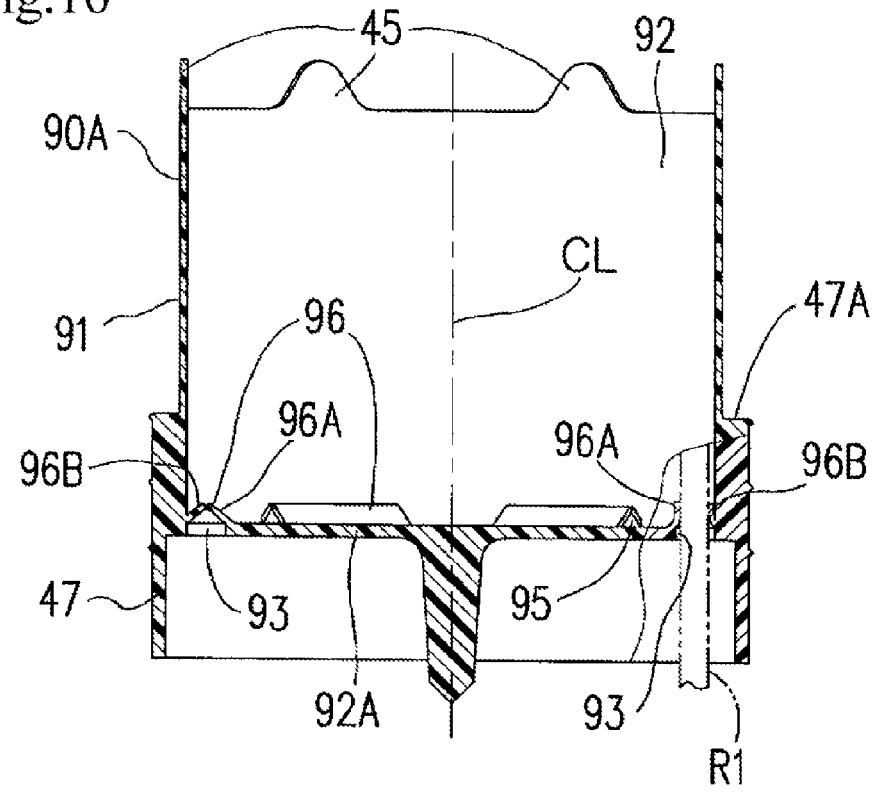
FIG. 16(*a*) is a cross-sectional view of a protecting cap of Modification 1 of the second embodiment, and FIG. 16(*b*) is a bottom view of FIG. 16(*a*).
Figure 16:
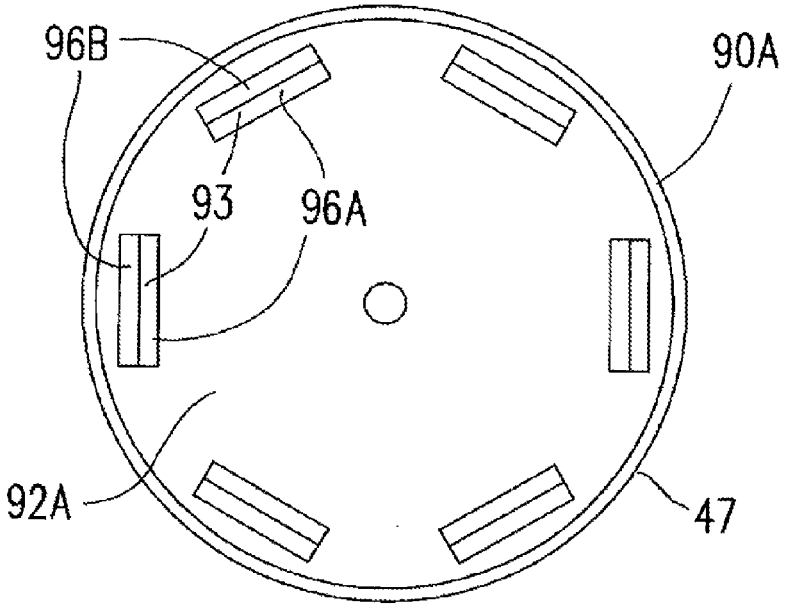

Modification 1 of Second Embodiment (FIG. 16)

A protecting cap 90A illustrated in FIG. 16 includes an openable and closable lid 96 inside the holes 93 formed on the bottom surface 92A. The lid 96 includes two plate portions 96A and 96B, and distal ends of the plate-shaped portions 96A and 96B are in contact with each other and the holes 93 are closed in a normal state. The plate portions 96A and 96B at that time supports each other in a state of being inclined, and include the space 95 formed in the vicinity of the base portions thereof. As illustrated in FIG. 16(*b*), when viewed from the bottom surface 92A side, edges of the plate portions 96A and 96B have an appearance of an H-shaped incision.

When the distal ends R1 of the fastening tool R are inserted into the holes 93, the plate portions 96A and 96B are deformed resiliently, and the distal ends thereof in a contact state are brought into a separated state, and hence the holes 93 are opened. When the distal ends R1 of the fastening tool R are pulled out from the holes 93, the plate portions 96A and 96B are restored to their original state in which the distal end is in contact thereto, and the holes 93 are closed.

Alternatively, the entire part of the protecting cap 90A or only the bottom surface 92A is formed of an elastic material such as rubber, and the holes 93 are formed by incisions. More specifically, when the distal ends R1 of the fastening tool R are inserted into the incisions, the peripheries of the incisions are resiliently deformed, and hence the incisions are opened, so that the fastening tool R may be engaged with an edge of the support base 23. By pulling out the distal ends R1 of the fastening tool R from the incisions, the opened incisions are restored to the original shape. The detailed possible shapes of the incisions include an H-shape, an I-shape, a Y-shape, an O-shape, and an arcuate shape.

Figure 17:
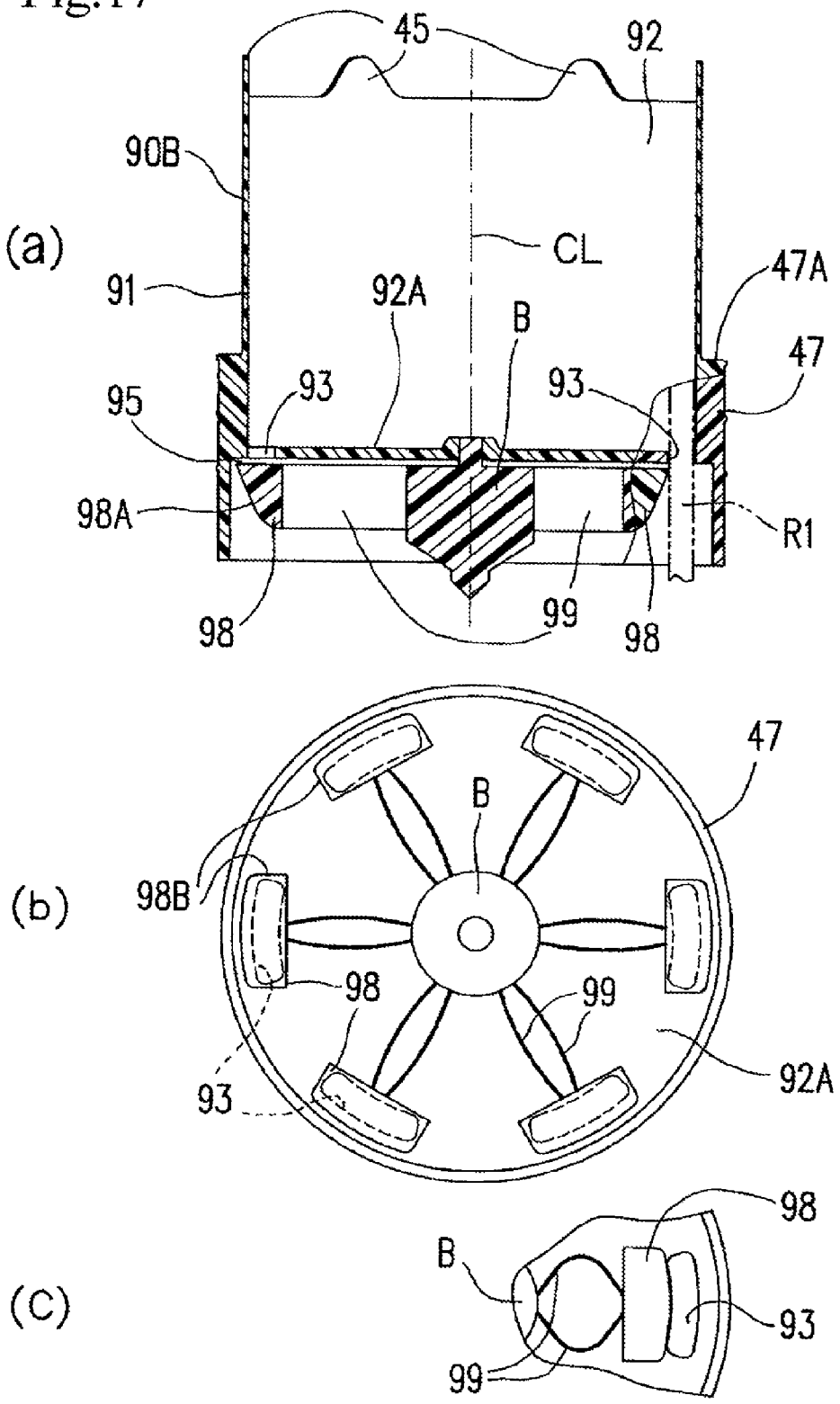
FIG. 17(*a*) is a cross-sectional view of a protecting cap of Modification 2 of the second embodiment, FIG. 17(*b*) is a bottom view of FIG. 17(*a*), and FIG. 17(*c*) is an enlarged view of a principal portion of a bottom surface when a lid is opened.

Modification 2 of Second Embodiment (FIG. 17)

In a protecting cap 90B illustrated in FIG. 17, the holes 93 is opened by moving a lid 98 which closes the holes 93 in the direction of the virtual centerline CL of the protecting cap 90B. The lid 98 is connected to a base B provided at a center portion of the protecting cap 90B by a leaf spring 99.

The lid 98 is formed with an inclined surface 98A, and when the fastening tool R is moved in the direction of the holes 93 in a state in which the distal ends R1 of the fastening tool R are in contact with the inclined surface 98A, the lid 98 moves toward the center axis of the protecting cap 90B by an effect of the inclined surface 98A, and hence the holes 93 are opened, so that the distal ends R1 of the fastening tool R may be inserted into the holes 93. At this time, the leaf spring 99 is in a bent state, and urges the lid 98 toward the holes 93. When the distal ends R1 of the fastening tool R are pulled out from the holes 93, the lid 98 is returned to the positions of the holes 93 by an urging force of the leaf spring 99, and the holes 93 are closed.

In the above-described description, a structure in which the holes 93 are opened by the movement of the lid 98 toward the center axis of the protecting cap 90B has been described. However the embodiment disclosed here is not limited thereto, and a configuration in which the holes 93 are opened by moving the lid 98 along the circumferential direction of the protecting cap 90B by rotating the fastening tool R with the distal ends R1 of the fastening tool R in abutment with a side surface 98B of the lid 98 is also applicable.

Figure 18:
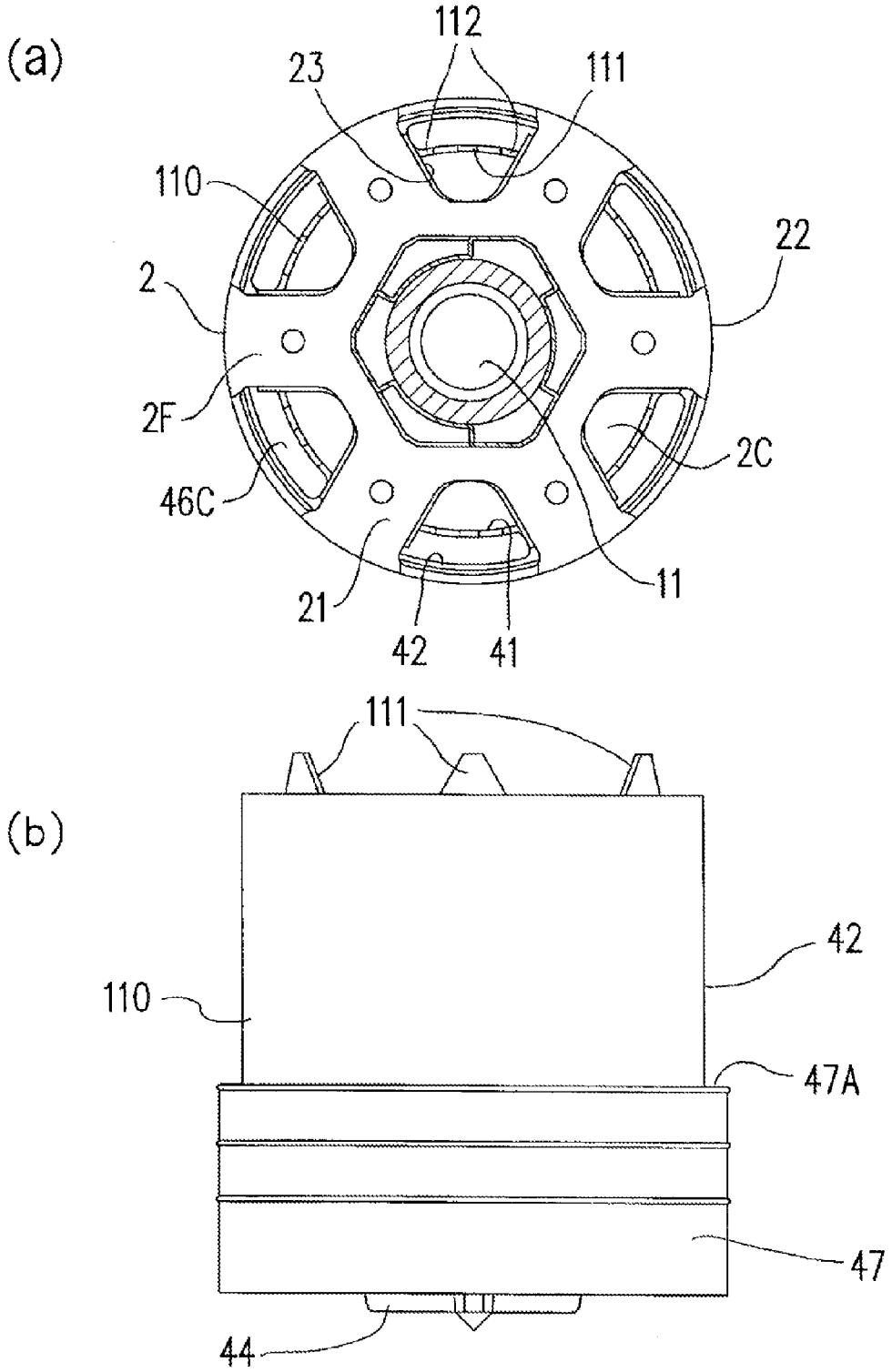
FIG. 18(*a*) is a plan view of a state in which a protecting cap is mounted on sprinkler head of a third embodiment, and FIG. 18(*b*) is a side view of the protecting cap of the third embodiment.

Third Embodiment (FIG. 18)

A protecting cap 110 of a third embodiment is different from the protecting cap 4 of the first embodiment in that tongue portions 111 are formed to be slightly smaller than those of the protecting cap 4. In other words, the tongue portions 111 of this embodiment are formed with gaps 112 between the tongue portions 111 and the openings 2C in a state of projecting into the openings 2C of the cylindrical member 2 as illustrated in FIG. 18.

With the provision of the gap 112 as described above, the protecting cap 4 is rotated in the circumferential direction along the inner periphery of the cylindrical member 2 so as to advance downward in a state in which the tongue portions 111 are inserted into the openings 2C, and is moved little by little downward while changing the direction of rotation alternately. Since the tongue portions 111 have substantially a triangular shape, the gaps between edges of the tongue portions 111 and the edges of the openings 2C are increased by moving the protecting cap 110 downward, the amount of movement in the circumferential direction may be increased. Accordingly, when paste is adhered on the side surface of the protecting cap at the time of constructing the ceiling, the protecting cap 110 may be demounted without giving damage to the paste by pulling out the protecting cap 110 from the cylindrical member 2 while rotating the protecting cap 110 in the circumferential direction.

Also, when the paste adhered on the side surface of the protecting cap 110 is peeled off by rotating the protecting cap 110 in the circumferential direction, since the tongue portions 111 have substantially a triangular shape, the amount of movement of the protecting cap 110 due to the rotation in the circumferential direction is small in the beginning, and the amount of movement of the protecting cap 110 in the circumferential direction is increased by changing the direction of rotation alternately and moving little by little downward, the amount of the movement of the protecting cap 110 in the circumferential direction is increased little by little, and hence the operation may be performed without giving damage to the paste.

The shapes and the configurations of the respective components described in the above-described embodiment may be changed as needed without departing the scope of the invention. For example, a change to a known shape other than those described above, and partial exchange, employment and elimination of the configurations described in the respective embodiments described above may be performed, and such alterations are included in the scope of the technical idea of the embodiment disclosed here.

REFERENCE SIGNS LIST

1 sprinkler head body, 2 cylindrical member, 3 cover plate unit, 4,70,90,110 protecting cap, 5 heat-sensitive breakdown portion, 6 deflector, 11 nozzle, 41 inner cylinder, 42 outer cylinder, 43 water drain hole, 44 gripping portion, 45,111 tongue portion, 46 coupling portion, 46C through space, 47 expanded portion, K notch, 71,92 head housing, 72 fastening tool insertion portion, 93 hole, 94,96,98 lid, 95 space, 99 leaf spring, 112 gap

What is claimed is:

1. A protecting cap configured to protect a sprinkler head by being mounted on a sprinkler having a sprinkler head body and a cylindrical member provided on the outside of the sprinkler head body, comprising:

an inner cylinder with a bottom surface and a head housing portion which is configured to house the sprinkler head body, an outer cylinder to be fitted in an end portion of the cylindrical member, the outer cylinder circumferentially surrounding the inner cylinder and extending along and in parallel to the inner cylinder;

a tongue portion extending from the inner cylinder and projecting into an opening;

a fastening tool insertion portion, located between the inner cylinder and the outer cylinder, configured to allow insertion of a fastening tool for mounting the sprinkler on a water supply pipe; and a coupling portion configured to connect the inner cylinder and the outer cylinder.

2. The protecting cap according to claim 1, wherein a penetrating space for guiding insertion of the fastening tool is formed between the inner cylinder and the outer cylinder.

3. The protecting cap according to claim 1, wherein a space is provided between the tongue portion and an edge of the opening in a state in which the tongue portion projects into the opening.

4. The protecting cap according to claim 1, wherein the tongue portion and the fastening tool insertion portion extend parallel to a longitudinal center axis of the inner cylinder.

5. The protecting cap according to claim 1, wherein the coupling portion has a side surface which extends in a direction parallel to a longitudinal center axis of the inner cylinder.

6. The protecting cap according to claim 1, wherein the coupling portion has a bottom surface which extends in a direction perpendicular to a longitudinal center axis of the inner cylinder.

7. The protecting cap according to claim 1, wherein the outer cylinder includes an extended portion extending downward from a lower end position of the outer cylinder.

8. The protecting cap according to claim 7, wherein the extended portion includes a groove on the inside thereof, the groove being configured to engage a projection formed on an outer peripheral surface of the fastening tool.

9. The protecting cap according to claim 8, comprising:

a grip portion provided on the bottom surface, wherein an end portion of the grip portion is arranged in a vicinity of the groove provided inside the extended portion.

10. The protecting cap according to claim 7, wherein a lower end of the extended portion projects downward beyond a lower end of the inner cylinder.

11. The protecting cap according to claim 1 comprising:

a water drain hole on an end of the bottom surface, a part of the water drain hole extends to the inner cylinder.

12. The protecting cap according to claim 11, wherein the bottom surface is an inclined surface having a downward gradient toward the water drain hole.

13. The protecting cap according to claim 1, comprising a hole or a notch on the outer cylinder.

14. The protecting cap according to claim 1, wherein the inner cylinder includes a notch notched in the vertical direction, and the coupling portion is provided at a notched end of the inner cylinder.

15. The protecting cap according to claim 5, wherein the sprinkler is mountable and demountable with respect to the water supply pipe by inserting the fastening tool through the fastening tool insertion portion.

16. The protecting cap according to claim 6, wherein the coupling portion is configured to allow connection of a cap demounting tool.

17. A sprinkler head comprising:

a sprinkler head body; and a cylindrical member provided on the outside of the sprinkler body, wherein a protecting cap is mounted on the sprinkler head body, the protecting cap comprising, an inner cylinder with a bottom surface and a head housing portion which is configured to house the sprinkler head body, an outer cylinder to be fitted in an end portion of the cylindrical member, the outer cylinder circumferentially surrounding the inner cylinder and extending along and in parallel to the inner cylinder;

a tongue portion extending from the inner cylinder and projecting into an opening;

a fastening tool insertion portion, located between the inner cylinder and the outer cylinder, configured to allow insertion of a fastening tool for mounting the sprinkler on a water supply pipe; and a coupling portion configured to connect the inner cylinder and the outer cylinder.

18. The protecting cap according to claim 1, wherein a cylindrical wall of the outer cylinder circumferentially surrounds an outside of a cylindrical wall of the inner cylinder.

19. The protecting cap according to claim 1, wherein the coupling portion is continuously extends from the outer cylinder to the inner cylinder.

20. The protecting cap according to claim 1, wherein the tongue portion is provided at a top portion of the inner cylinder opposite from the bottom surface.

* * * * *